US008727041B2

(12) United States Patent
Radford

(10) Patent No.: US 8,727,041 B2
(45) Date of Patent: May 20, 2014

(54) EARTH-BORING TOOLS HAVING EXPANDABLE MEMBERS AND RELATED METHODS

(75) Inventor: Steven R. Radford, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 715 days.

(21) Appl. No.: 12/894,937

(22) Filed: Sep. 30, 2010

(65) Prior Publication Data

US 2011/0073330 A1 Mar. 31, 2011

Related U.S. Application Data

(60) Provisional application No. 61/247,092, filed on Sep. 30, 2009.

(51) Int. Cl.
*E21B 7/28* (2006.01)

(52) U.S. Cl.
USPC ..... 175/269; 175/285; 175/291

(58) Field of Classification Search
USPC ..... 175/267–269, 285, 291
See application file for complete search history.

(56) References Cited

U.S. PATENT DOCUMENTS

| | | | | |
|---|---|---|---|---|
| 4,635,738 | A | 1/1987 | Schillinger et al. | |
| 5,402,856 | A | 4/1995 | Warren et al. | |
| 5,495,899 | A | 3/1996 | Pastusek | |
| 5,957,223 | A | 9/1999 | Doster et al. | |
| RE36,817 | E | 8/2000 | Pastusek | |
| 6,360,831 | B1 | 3/2002 | Akesson et al. | |
| 7,036,611 | B2 | 5/2006 | Radford et al. | |
| 7,308,937 | B2 | 12/2007 | Radford et al. | |
| 7,584,811 | B2 | 9/2009 | Fanuel et al. | |
| 7,900,717 | B2 * | 3/2011 | Radford et al. | 175/269 |
| 8,028,767 | B2 * | 10/2011 | Radford et al. | 175/269 |
| 2008/0105464 | A1 | 5/2008 | Radford | |
| 2008/0105465 | A1 | 5/2008 | Radford et al. | |
| 2008/0110678 | A1 | 5/2008 | Radford et al. | |
| 2008/0128175 | A1 | 6/2008 | Radford et al. | |
| 2009/0032308 | A1 | 2/2009 | Eddison | |
| 2009/0145666 | A1 * | 6/2009 | Radford et al. | 175/269 |

OTHER PUBLICATIONS

Radford, Steven, et al., "Novel Concentric Expandable Stabilizer Results in Increased Penetration Rates and Drilling Efficiency with Reduced Vibration," SPE/IADC 119534, Copyright 2009, SPE/IADC Drilling Conference and Exhibition, Amsterdam, The Netherlands, Mar. 17-19, 2009, pp. 1-13.

International Search Report for International Application No. PCT. US2010/050889 mailed May 20, 2011, 3 pages.

International Written Opinion for International Application No. PCT. US2010/050889 mailed May 20, 2011, 3 pages.

* cited by examiner

*Primary Examiner* — Blake Michener
(74) *Attorney, Agent, or Firm* — TraskBritt

(57) ABSTRACT

Expandable apparatus for use in subterranean boreholes include a tubular body having at least one opening and at least one member positioned within the at least one opening. The member is configured to move between a retracted position and an extended position. A sleeve member including a constricted portion may be disposed in the tubular body and may selectively retain the at least one member in the retracted position. In some embodiments, the sleeve member may be biased in an initial position. Methods of moving a member of an expandable apparatus include repeating retracting and expanding of the member. Methods of triggering an expandable apparatus include forming a constriction in a fluid flow path extending through a sleeve member to move the sleeve member in a downhole direction responsive to fluid flow.

22 Claims, 16 Drawing Sheets

EARTH-BORING TOOLS HAVING EXPANDABLE MEMBERS AND RELATED METHODS

CROSS-REFERENCE TO RELATED APPLICATION

This application claims the benefit of U.S. Provisional Patent Application Ser. No. 61/247,092, filed Sep. 30, 2009, the disclosure of which is hereby incorporated herein in its entirety by this reference.

TECHNICAL FIELD

Embodiments of the present invention relate generally to an expandable apparatus for use in a subterranean borehole and, more particularly, to an expandable reamer apparatus for enlarging a subterranean borehole and to an expandable stabilizer apparatus for stabilizing a bottom home assembly during a drilling operation.

BACKGROUND

Expandable reamers are typically employed for enlarging subterranean boreholes. Conventionally, in drilling oil, gas, and geothermal wells, casing is installed and cemented to prevent the well bore walls from caving into the subterranean borehole while providing requisite shoring for subsequent drilling operation to achieve greater depths. Casing is also conventionally installed to isolate different formations, to prevent cross-flow of formation fluids, and to enable control of formation fluids and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. An example of an eccentric bit is disclosed in U.S. Pat. No. 4,635,738, which is assigned to the assignee of the present invention. A bi-center bit assembly employs two longitudinally superimposed bit sections with laterally offset axes, which, when rotated, produce an enlarged borehole diameter. An example of a bi-center bit is disclosed in U.S. Pat. No. 5,957,223, which is also assigned to the assignee of the present invention.

Another conventional approach used to enlarge a subterranean borehole includes employing an extended bottom hole assembly with a pilot drill bit at the distal end thereof and a reamer assembly some distance above the pilot drill bit. This arrangement permits the use of any conventional rotary drill bit type (e.g., a rock bit or a drag bit), as the pilot bit and the extended nature of the assembly permit greater flexibility when passing through tight spots in the borehole as well as the opportunity to effectively stabilize the pilot drill bit so that the pilot drill bit and the following reamer will traverse the path intended for the borehole. This aspect of an extended bottom hole assembly is particularly significant in directional drilling. The assignee of the present invention has, to this end, designed as reaming structures so called "reamer wings," which generally comprise a tubular body having a fishing neck with a threaded connection at the top thereof and a tong die surface at the bottom thereof, also with a threaded connection. U.S. Pat. Nos. RE 36,817 and 5,495,899, both of which are assigned to the assignee of the present invention, disclose reaming structures including reamer wings. The upper midportion of the reamer wing tool includes one or more longitudinally extending blades projecting generally radially outwardly from the tubular body, and PDC cutting elements are provided on the blades.

As mentioned above, conventional expandable reamers may be used to enlarge a subterranean borehole and may include blades that are pivotably or hingedly affixed to a tubular body and actuated by way of a piston disposed therein as disclosed by, for example, U.S. Pat. No. 5,402,856 to Warren. In addition, U.S. Pat. No. 6,360,831 to Akesson et al. discloses a conventional borehole opener comprising a body equipped with at least two hole opening arms having cutting means that may be moved from a position of rest in the body to an active position by exposure to pressure of the drilling fluid flowing through the body. The blades in these reamers are initially retracted to permit the tool to be run through the borehole on a drill string, and, once the tool has passed beyond the end of the casing, the blades are extended so the bore diameter may be increased below the casing.

BRIEF SUMMARY

In some embodiments, the present invention includes an expandable apparatus for use in a subterranean borehole. The expandable apparatus includes a tubular body having a longitudinal bore and at least one opening in a wall of the tubular body and at least one member positioned within the at least one opening in the wall of the tubular body. The member is configured to move between a retracted position and an extended position. The expandable apparatus also includes a sleeve member disposed in the tubular body and having a longitudinal bore forming a fluid passageway through the sleeve member to allow fluid to flow therethrough. The sleeve member selectively retains the at least one member in the retracted position. The sleeve member comprises a constricted portion of the longitudinal bore having a cross-sectional area less than a cross-sectional area of an adjacent portion of the longitudinal bore. The constricted portion constricts the fluid passageway through the sleeve member to displace the sleeve member in a downhole direction responsive to a selected flow rate.

In additional embodiments, the present invention includes an expandable apparatus for use in a subterranean borehole. The expandable apparatus includes a tubular body having at least one opening extending between a longitudinal bore of the tubular body and an outer surface of the tubular body. The longitudinal bore forms a fluid passageway through the tubular body. At least one member is positioned within the at least one opening of the tubular body. The at least one member is configured to move between a retracted position and an extended position. The expandable apparatus also includes a sleeve member disposed within the longitudinal bore and biased in an initial position. The sleeve member is configured to selectively retain the at least one member in the retracted position. The sleeve member comprises a constricted portion of the fluid passageway and is configured to move in a downhole direction responsive to an increased pressure in the sleeve member formed by the constricted portion of the fluid passageway.

In yet additional embodiments, the present invention includes an expandable apparatus for use in a subterranean borehole. The expandable apparatus includes a tubular body having at least one opening in a wall of the tubular body and at least one member positioned within the at least one opening in the wall of the tubular body. The member is configured to move between a retracted position and an extended position. The expandable apparatus is configured to move the at least one member between the expanded position and the retracted position an infinite amount of times.

In yet additional embodiments, the present invention includes a method of moving at least one member of an expandable apparatus. The method includes expanding at least one member of an expandable apparatus responsive to a fluid flow through the expandable apparatus, retracting the at least one member of the expandable apparatus responsive to the fluid flow through the expandable apparatus, and repeating the expanding and retracting of the at least one member an infinite amount of times.

In yet additional embodiments, the present invention includes a method for triggering an expandable apparatus for use in a subterranean borehole. The method includes forming a constriction in a fluid flow path extending through a sleeve member at least partially disposed in a tubular body of an expandable apparatus, supplying drilling fluid through the fluid flow path at a selected flow rate, increasing a pressure of fluid within the sleeve member responsive to the restriction of the fluid flow path through the sleeve member by the constriction, moving the sleeve member in a downhole direction from a first position to a second position responsive to the increase of the pressure of the fluid within the sleeve member, and moving at least one member of the expandable apparatus from a retracted position to an extended position responsive to the movement of the sleeve member from the first position to the second position.

BRIEF DESCRIPTION OF THE DRAWINGS

While the specification concludes with claims particularly pointing out and distinctly claiming what are regarded as embodiments of the invention, various features and advantages of embodiments of the invention may be more readily ascertained from the following description of some embodiments of the invention, when read in conjunction with the accompanying drawings, in which:

DETAILED DESCRIPTION

The illustrations presented herein are, in some instances, not actual views of any particular earth-boring tool, expandable apparatus, cutting element, or other feature of an earth-boring tool, but are merely idealized representations that are employed to describe embodiments the present invention. Additionally, elements common between figures may retain the same numerical designation.

As used herein, the terms "distal" and "proximal" are relative terms used to describe portions of an expandable apparatus or members thereof with reference to the surface of a formation to be drilled. For example, a "distal" portion of an expandable apparatus is the portion relatively more distant from the surface of the formation when the expandable apparatus is disposed in a wellbore extending into the formation during a drilling or reaming operation. A "proximal" portion of an expandable apparatus is the portion in closer relative proximity to the surface of the formation when the expandable apparatus is disposed in a wellbore extending into the formation during a drilling or reaming operation.

In some embodiments, the expandable apparatus described herein may be similar to the expandable apparatus described in United States Patent Application Publication No. US 2008/0128175 A1, which application was filed Dec. 3, 2007 and entitled "Expandable Reamers for Earth-Boring Applications," the entire disclosure of which is incorporated herein by reference. The expandable apparatus of the present invention, however, may include a different actuation mechanism, as discussed in further detail hereinbelow.

Figure 1:
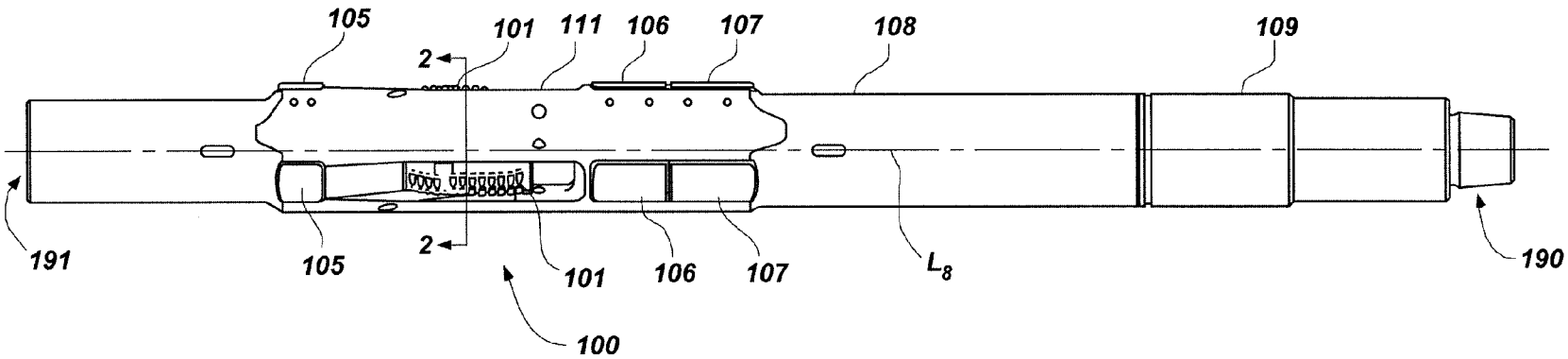
FIG. 1 is a side view of an embodiment of an expandable reamer apparatus in accordance with an embodiment of the present invention.
Figure 17:
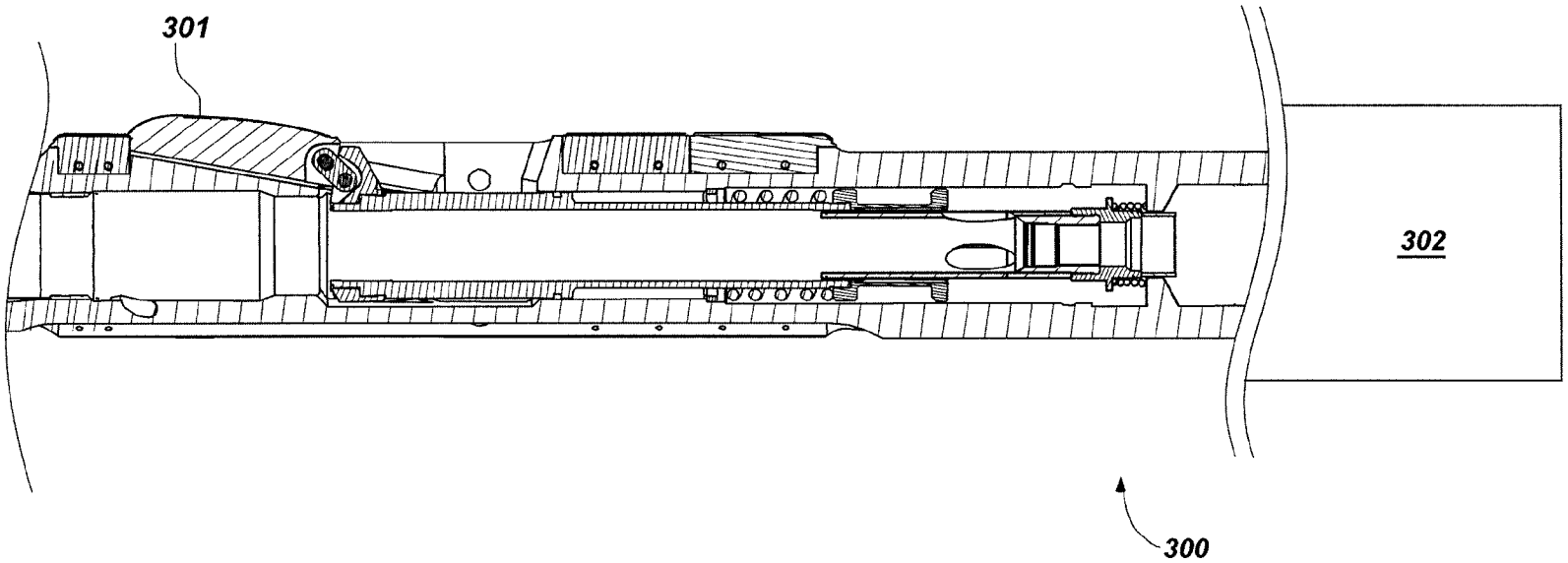
FIG. 17 shows a partial, longitudinal cross-sectional view of an embodiment of an expandable apparatus in an expanded position coupled to a pilot bit.

An embodiment of an expandable apparatus (e.g., an expandable reamer apparatus 100) of the invention is shown in FIG. 1. The expandable reamer apparatus 100 may include a generally cylindrical tubular body 108 having a longitudinal axis $L_8$. The tubular body 108 of the expandable reamer apparatus 100 may have a distal end 190, a proximal end 191, and an outer surface 111. The distal end 190 of the tubular body 108 of the expandable reamer apparatus 100 may include a set of threads (e.g., a threaded male pin member) for connecting the distal end 190 to another section of a drill string or another component of a bottom-hole assembly (BHA), such as, for example, a drill collar or collars carrying a pilot drill bit 302 (FIG. 17) for drilling a well bore. In some embodiments, the expandable reamer apparatus 100 may include a lower sub 109 that connects to the lower box connection of the reamer body 108. Similarly, the proximal end 191 of the tubular body 108 of the expandable reamer apparatus 100 may include a set of threads (e.g., a threaded female box member) for connecting the proximal end 191 to another section of a drill string or another component of a bottom-hole assembly (BHA). It is noted that while the embodiment of FIG. 1 illustrates an expandable reamer apparatus 100 carrying blades 101, the expandable apparatus may comprises other apparatus such as, for example, as shown in FIG. 17, an expandable stabilizer apparatus 300 carrying stabilizer blocks 301 thereon for stabilizing a drilling assembly during a drilling operation.

Figure 11:
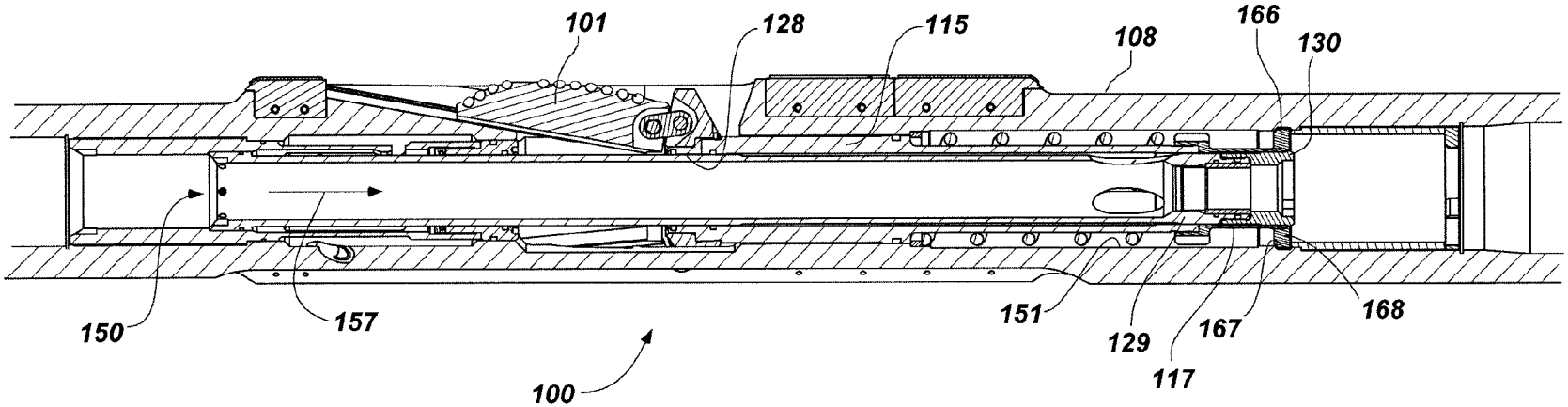
FIG. 11 shows a partial, longitudinal cross-sectional illustration of an embodiment of an expandable reamer apparatus in a closed, or retraced, initial tool position.

Three sliding members (e.g., blades 101, stabilizer blocks, etc.) are positionally retained in circumferentially spaced relationship in the tubular body 108 as further described below and may be provided at a position along the expandable reamer apparatus 100 intermediate the first distal end 190 and the second proximal end 191. The blades 101 may be comprised of steel, tungsten carbide, a particle-matrix composite material (e.g., hard particles dispersed throughout a metal matrix material), or other suitable materials as known in the art. The blades 101 are retained in an initial, retracted position within the tubular body 108 of the expandable reamer apparatus 100 as illustrated in FIG. 11, but may be moved responsive to application of hydraulic pressure into the extended position (shown in FIG. 14) and moved into a retracted position (shown in FIG. 15) when desired, as will be described herein. The expandable reamer apparatus 100 may be configured such that the blades 101 engage the walls of a subterranean formation surrounding a well bore in which expandable reamer apparatus 100 is disposed to remove formation material when the blades 101 are in the extended position, but are not operable to engage the walls of a subterranean formation within a well bore when the blades 101 are in the retracted position. While the expandable reamer apparatus 100 includes three blades 101, it is contemplated that one, two or more than three blades may be utilized to advantage. Moreover, while the blades 101 of expandable reamer apparatus 100 are symmetrically circumferentially positioned about the longitudinal axis $L_8$ along the tubular body 108, the blades may also be positioned circumferentially asymmetrically as well as asymmetrically about the longitudinal axis $L_8$. The expandable reamer apparatus 100 may also include a plurality of stabilizer pads to stabilize the tubular body 108 of expandable reamer apparatus 100 during drilling or reaming processes. For example, the expandable reamer apparatus 100 may include upper hard face pads 105, mid hard face pads 106, and lower hard face pads 107.

Figure 2:
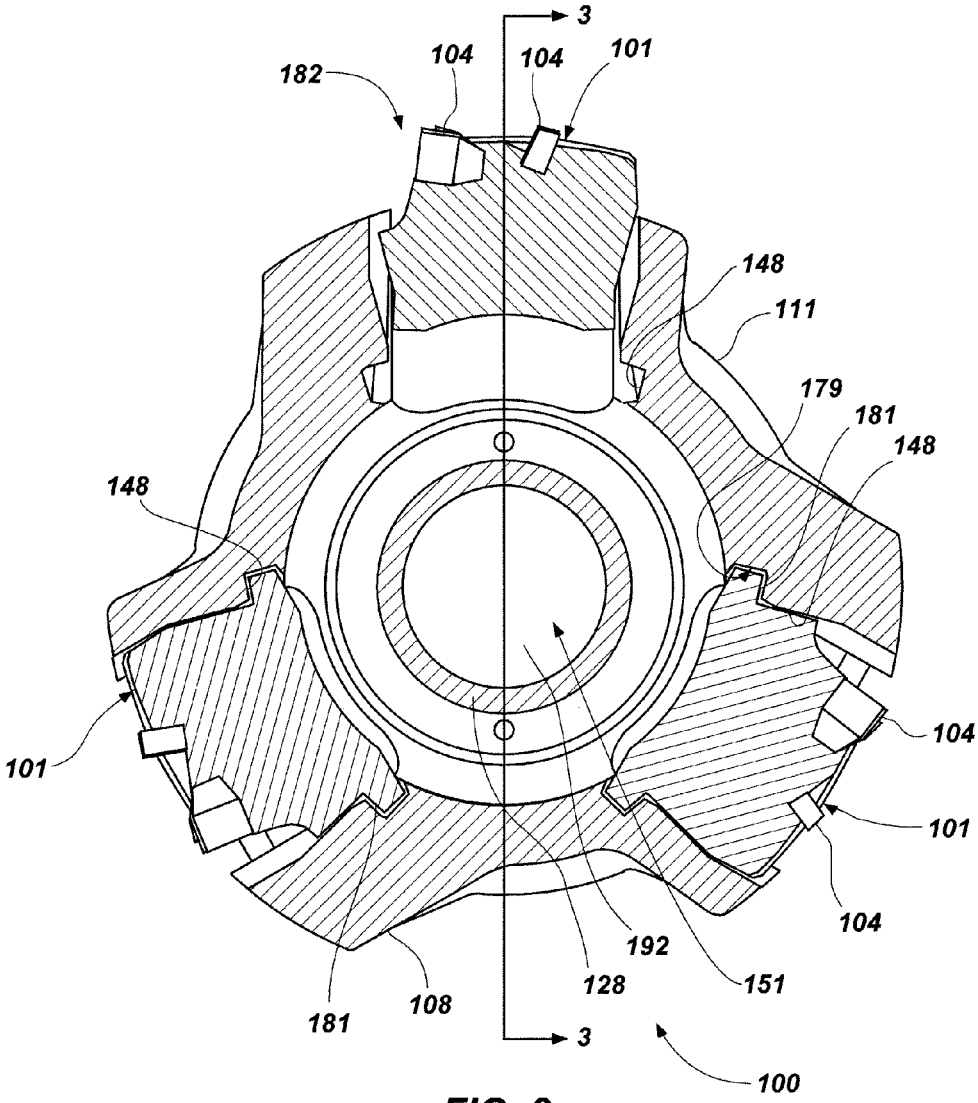
FIG. 2 shows a transverse cross-sectional view of the expandable reamer apparatus as indicated by section line 2-2 in FIG. 1.

FIG. 2 is a cross-sectional view of the expandable reamer apparatus 100 shown in FIG. 1 taken along section line 2-2 shown therein. As shown in FIG. 2, the elongated cylindrical wall of the tubular body 108 encloses a fluid passageway 192 that extends longitudinally through the tubular body 108. Fluid may travel through the fluid passageway 192 in a longitudinal bore 151 of the tubular body 108 (and a longitudinal bore of a sleeve member) in a bypassing relationship to substantially shield the blades 101 from exposure to drilling fluid, particularly in the lateral direction, or normal to the longitudinal axis $L_8$. The particulate-entrained fluid is less likely to cause build-up or interfere with the operational aspects of the expandable reamer apparatus 100 by shielding the blades 101 from exposure with the fluid. However, it is recognized that shielding of the blades 101 is not necessary to the operation of the expandable reamer apparatus 100 where, as explained in further detail below, the operation (i.e., extension from the initial position, the extended position and the retracted position) occurs by an axially directed force that is the net effect of the fluid pressure and spring biases forces. In this embodiment, the axially directed force directly actuates the blades 101 by axially influencing an actuating feature, such as a push sleeve 115 (shown in FIG. 3) for example, and without limitation, as described herein below.

Referring still to FIG. 2, to better describe aspects of embodiments of the invention, one of blades 101 is shown in the outward or extended position while the other blades 101 are shown in the initial or retracted positions. The expandable reamer apparatus 100 may be configured such that the outermost radial or lateral extent of each of the blades 101 is recessed within the tubular body 108 when in the initial or retracted positions so as to not extend beyond the greatest extent of outer diameter of the tubular body 108. Such an arrangement may protect the blades 101 as the expandable reamer apparatus 100 is disposed within a casing of a borehole, and may enable the expandable reamer apparatus 100 to pass through such casing within a borehole. In other embodiments, the outermost radial extent of the blades 101 may coincide with or slightly extend beyond the outer diameter of the tubular body 108. The blades 101 may extend beyond the outer diameter of the tubular body 108 when in the extended position, to engage the walls of a borehole in a reaming operation.

The three sliding blades 101 may be retained in three blade tracks 148 formed in the tubular body 108. The blades 101 each carry a plurality of cutting elements 104 for engaging the material of a subterranean formation defining the wall of an open borehole when the blades 101 are in an extended position (shown in FIG. 14). The cutting elements 104 may be polycrystalline diamond compact (PDC) cutters or other cutting elements known in the art.

Optionally, one or more of the blades 101 may be replaced with stabilizer blocks having guides and rails as described herein for being received into grooves 179 of the track 148 in the expandable reamer apparatus 100, which may be used as expandable concentric stabilizer rather than a reamer, which may further be utilized in a drill string with other concentric reamers or eccentric reamers.

Figure 3:
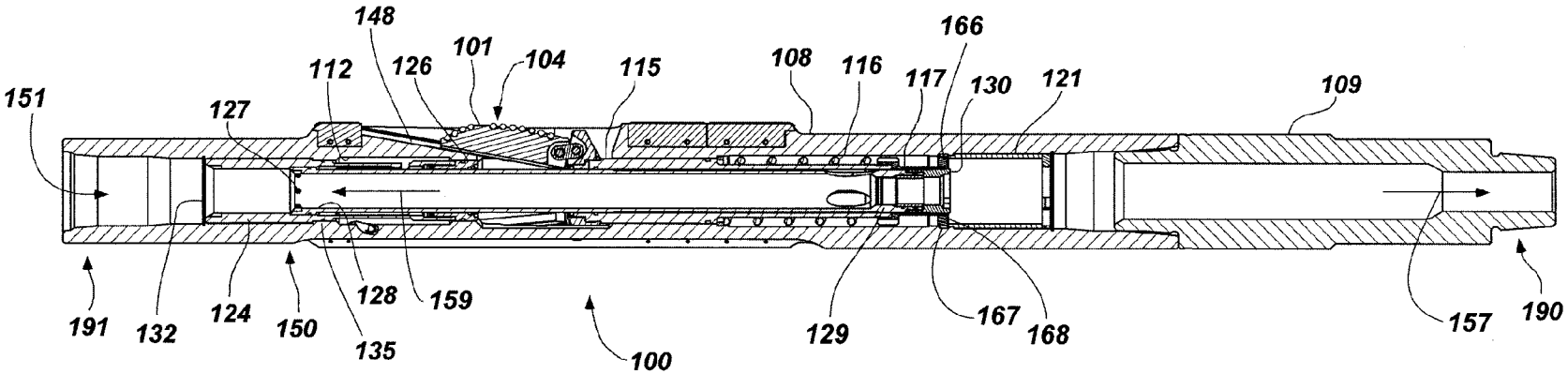
FIG. 3 shows a longitudinal cross-sectional view of the expandable reamer apparatus shown in FIG. 1.
Figure 8:
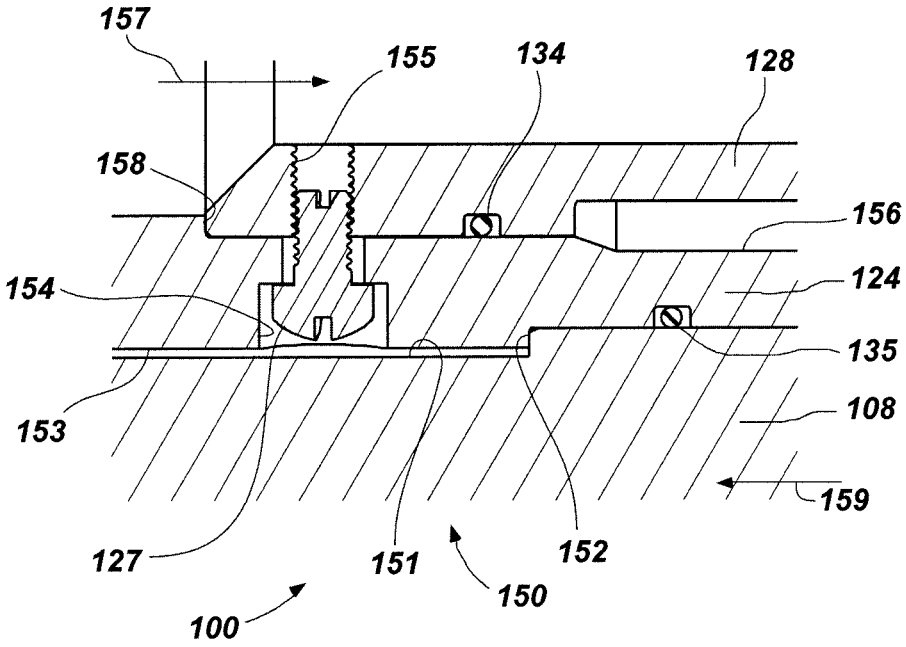
FIG. 8 shows a cross-sectional view of a shear assembly of an embodiment of an expandable reamer apparatus.

FIG. 3 is another cross-sectional view of the expandable reamer apparatus 100 including blades 101 shown in FIGS. 1 and 2 taken along section line 3-3 shown in FIG. 2. The expandable reamer apparatus 100 may include a shear assembly 150 for retaining the expandable reamer apparatus 100 in the initial position by securing a sleeve member (e.g., a traveling sleeve 128) toward the proximal end 191 of the tubular body 108. The shear assembly 150 includes an uplock sleeve 124, one or more shear screws 127, and the traveling sleeve 128. As shown in greater detail in FIG. 8, the uplock sleeve 124 is retained within the longitudinal bore 151 of the tubular body 108 between a lip 152 and a retaining ring 132, and includes a seal 135 (e.g., an O-ring seal) to prevent fluid from flowing between the outer surface 153 of the uplock sleeve 124 and an inner surface 112 of the tubular body 108. The uplock sleeve 124 includes shear slots 154 for retaining each of the shear screws 127, where, in the current embodiment of the invention, each shear screw 127 is threaded into a shear port 155 of the traveling sleeve 128. The shear screws 127 hold the traveling sleeve 128 at least partially within the uplock sleeve 124 to conditionally prevent the traveling sleeve 128 from axially moving in a downhole direction 157 (i.e., toward the distal end 190 (FIG. 1) of the expandable reamer apparatus 100). The uplock sleeve 124 includes an inner lip 158 to prevent the traveling sleeve 128 from moving in the uphole direction 159 (i.e., toward the proximal end 191 (FIG. 1) of the expandable reamer apparatus 100). A seal 134 (e.g., an O-ring seal) seals an outer surface 162 of the traveling sleeve 128 between an inner surface 156 of the uplock sleeve 124. When the shear screws 127 are sheared, the traveling sleeve 128 may axially travel within the tubular body 108 in the downhole direction 157. In some embodiments, the portions of the shear screws 127 when sheared may be retained within the uplock sleeve 124 and the traveling sleeve 128 in order to prevent the portions from becoming loose or being lodged in other components when drilling the borehole. While shear screws 127 are shown, other shear elements may be used (e.g., a shear rod, a shear wire, a shear pin, etc.). Optionally, other shear elements may include structure for positive retention within constituent components after being exhausted, similar in manner to the shear screws 127 of the current embodiment of the invention.

Referring again to FIG. 3, the expandable reamer apparatus 100 may include a lower sub 109 that connects to the lower box connection of the reamer body 108. The lower sub 109, although not required, may provide for more efficient connection to other downhole equipment, downhole tools, etc.

Figure 4:
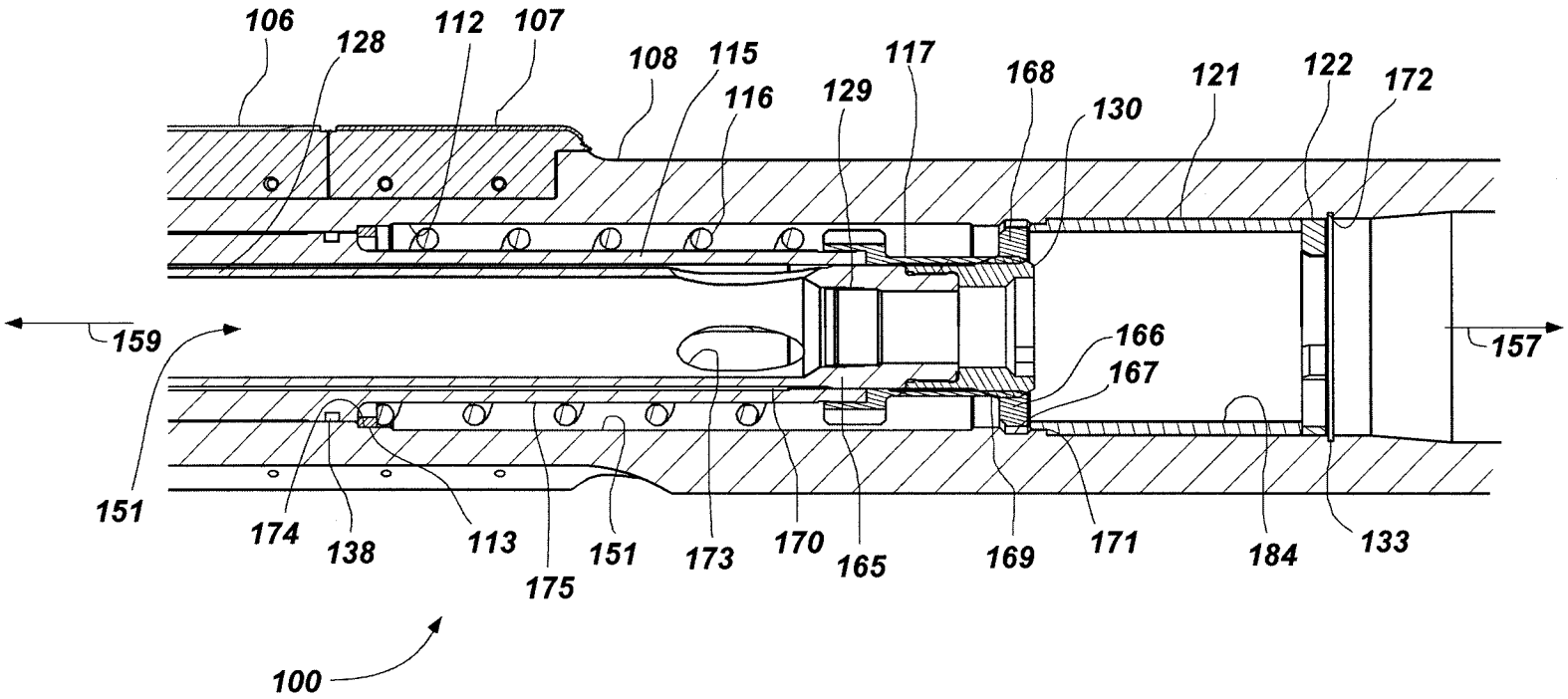
FIG. 4 shows an enlarged cross-sectional view of a portion of the expandable reamer apparatus shown in FIG. 3.

As shown in FIG. 4, a distal end 165 of the traveling sleeve 128 which includes a seat stop sleeve 130, is aligned, axially guided and supported by an annular piston or sleeve (e.g., a portion of the push sleeve 115). For example, a sleeve member (e.g., the push sleeve 115) may include a locking member (e.g., a lowlock sleeve 117) that may be axially coupled to the push sleeve 115 at a distal portion thereof. The push sleeve 115 may be cylindrically retained between the traveling sleeve 128 and the inner surface 112 of the tubular body 108. When the traveling sleeve 128 is in the initial position during drilling, the hydraulic pressure may act on the push sleeve 115 coupled the lowlock sleeve 117 between the outer surface 162 of the traveling sleeve 128 and the inner surface 112 of the tubular body 108. With or without hydraulic pressure when the expandable reamer apparatus 100 is in the initial position, the push sleeve 115 is prevented from moving in the uphole direction 159 by a lowlock assembly (e.g., the push sleeve 115 is prevented from moving by one or more dogs 166 of the lowlock sleeve 117 engaged with the tubular body 108).

The dogs 166 are positionally retained between an annular groove 167 in the longitudinal bore 151 of the tubular body 108 and the seat stop sleeve 130. Each dog 166 of the lowlock sleeve 117 is a collet or locking dog latch having an expandable detent 168 that may engage the groove 167 of the tubular body 108 when compressively engaged by the seat stop sleeve 130. The dogs 166 hold the lowlock sleeve 117 in place and prevent the push sleeve 115 from moving in the uphole direction 159 until the seat stop sleeve 130, with its larger outer diameter 169, travels beyond the lowlock sleeve 117 enabling the dogs 166 to retract axially inward toward the smaller outer diameter 170 of the traveling sleeve 128. When the dogs 166 retract axially inward they may be disengaged from the groove 167 of the tubular body 108, enabling the push sleeve 115 to move responsive to hydraulic pressure primarily in the axial direction (i.e., in the uphole direction 159).

Figure 5:
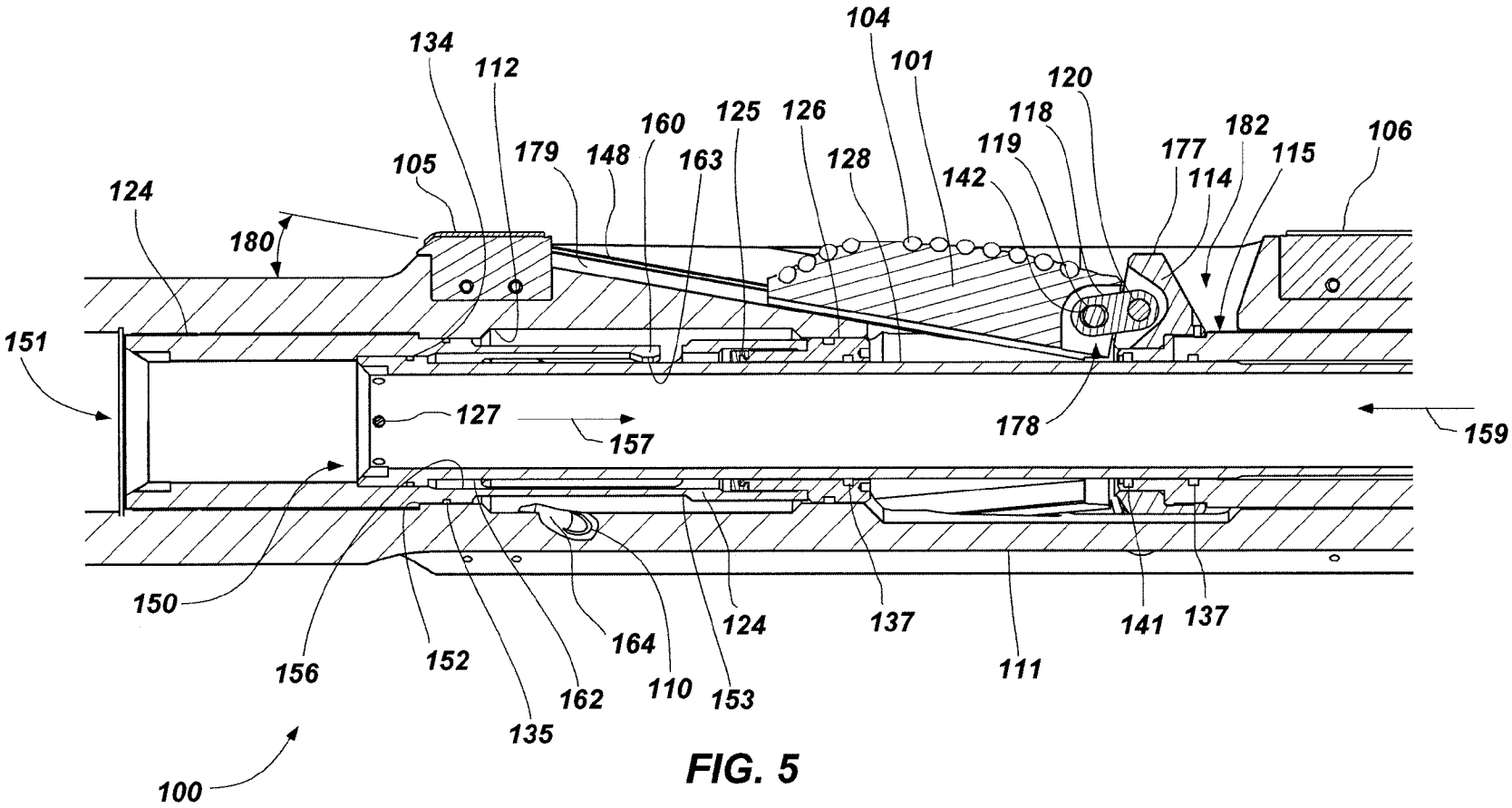
FIG. 5 shows an enlarged cross-sectional view of another portion of the expandable reamer apparatus shown in FIG. 3.
Figure 9:
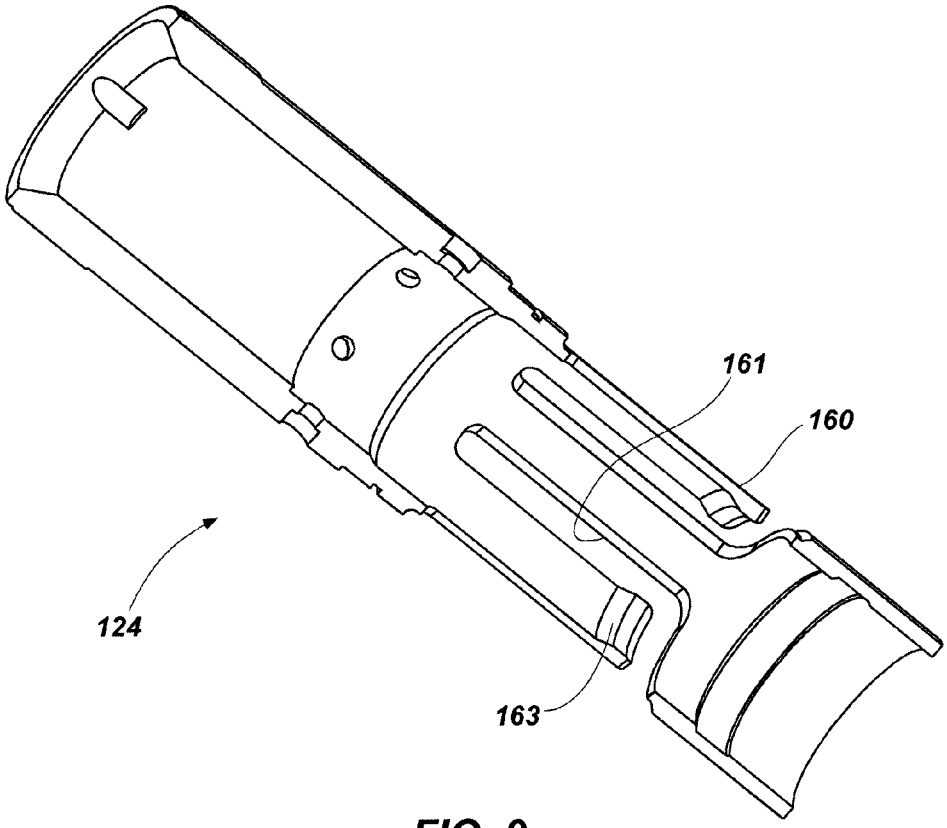
FIG. 9 shows a cross-sectional view of an uplock sleeve of an embodiment of an expandable reamer apparatus.

Referring now to FIG. 5, uplock sleeve 124 (also shown in greater detail in FIG. 9) further includes a collet 160 that axially retains a seal sleeve 126 between the inner bore 151 of the tubular body 108 and an outer bore 162 of the traveling sleeve 128. The uplock sleeve 124 also includes one or more ears 163 and one or more ports 161 axially spaced there around. When the traveling sleeve 128 is positioned a sufficient axial distance in downhole direction 157, the one or more ears 163 spring radially inward to lock the motion of the traveling sleeve 128 between the ears 163 of the uplock sleeve 124 and a shock absorbing member 125 mounted upon an upper end of the seal sleeve 126. As the traveling sleeve 128 positions a sufficient axial distance in the downhole direction 157, the one or more ports 161 of the uplock sleeve 124 may enable fluid to communicate with a nozzle intake port 164 from the fluid passageway 192 (FIG. 2). The shock absorbing member 125 of the seal sleeve 126 provides spring retention of the traveling sleeve 128 with the ears of the uplock sleeve 124 and also mitigates impact shock caused by the traveling sleeve 128 when its motion is stopped by the seal sleeve 126.

Shock absorbing member 125 may comprise a flexible or compliant material, such as, for instance, an elastomer or other polymer. In some embodiments, the shock absorbing member 125 may comprise a nitrile rubber. Utilizing a shock absorbing member 125 between the traveling sleeve 128 and the seal sleeve 126 may reduce or prevent deformation of at least one of the traveling sleeve 128 and the seal sleeve 126 that may otherwise occur due to impact therebetween.

In some embodiments, the seal sleeve 126 may axially align, guide, and support the traveling sleeve 128 within the tubular body 108.

It should be noted that any sealing elements (e.g., seals, seal rings, etc.) or shock absorbing members disclosed herein that are included within expandable reamer apparatus 100 may comprise any suitable material as known in the art, such as, for instance, a polymer or elastomer. Optionally, a material comprising a sealing element may be selected for relatively high temperature (e.g., about 400° Fahrenheit (approximately 204° C.) or greater) use. For example, seals may be comprised of a polytetrafluoroethylene (PTFE), marked commercially as TEFLON® polymers, polyetheretherketone (PEEK) material, another polymer material, or other natural or synthetic elastomer, or may comprise a metal to metal seal suitable for expected borehole conditions. Specifically, any sealing element or shock absorbing member disclosed herein or other sealing elements included by an expandable reamer apparatus in accordance with embodiments of the present invention may comprise a material configured for relatively high temperature use, as well as for use in highly corrosive borehole environments.

As further shown in FIG. 5, the expandable reamer apparatus 100 may include nozzles 110 (e.g., tungsten carbide nozzles). The nozzles 110 may be provided to cool and clean the cutting elements 104 and clear debris from blades 101 during drilling. The nozzles 110 may be configured to direct drilling fluid towards the blades 101 in the downhole direction 157, but may be configured to direct fluid laterally or in the uphole direction 159. For example, the nozzles 110 may be directed in the direction of flow through the expandable reamer apparatus 100 from within the tubular body 108 downward and outward radially to the annulus between tubular body 108 and a borehole. Directing the nozzles 110 in such a downward direction causes counterflow as the flow exits the nozzle and mixes with the annular moving counter flow returning up the borehole and may improve blade cleaning and cuttings removal. The nozzles 110 are directed at the cutters of the blades 101 for maximum cleaning, and may be directionally optimized using computational fluid dynamics (CFD) analysis.

Referring now to FIGS. 4 and 5, the shear screws 127 of the shear assembly 150, retaining the traveling sleeve 128 and the uplock sleeve 124 in the initial position, are used to provide or create a trigger, releasing when pressure builds to a predetermined, threshold value. When the hydraulic pressure within the expandable reamer apparatus 100 is increased above a threshold level, the shear screws 127 of the shear assembly 150 will fail, thereby enabling the traveling sleeve 128 to travel in the longitudinal direction with the expandable reamer apparatus 100, as described below. The predetermined threshold value at which the shear screws 127 shear under hydraulic pressure caused by drilling fluid within the expandable reamer apparatus 100 may be selected based on the number of shear screws 127 used in the shear assembly 150. It is noted that the predetermined threshold value at which the shear screws 127 shear may also be selected using the size (e.g., diameter) and material composition of the shear screws 127. In some embodiments, one shear screw 127 may be selected for use in the shear assembly 150 to give the shear assembly 150 a relatively low predetermined threshold value at which the shear screw 127 shears and thereby, the shear assembly 150 fails and releases the traveling sleeve 128 from the uplock sleeve 124. For example, the one shear screw 127 may be selected such that the shear screw 127 will shear at approximately 300 psi (approximately 2,068 kPa). In other embodiments, more shear screws 127 may be utilized in the shear assembly 150 to exhibit relatively higher predetermined threshold values. For example, two shear screws 127 may exhibit a threshold value of 600 psi (approximately 4,137 kPa), three shear screws 127 may exhibit a threshold value of 1000 psi (approximately 6,895 kPa), and four shear screws 127 may exhibit a threshold value of 1400 psi (approximately 9,653 kPa), etc. It is noted that the pressure may range to a greater or lesser extent than presented herein to trigger the expandable reamer apparatus 100. It is further noted that the values presented herein are for exemplary purposes. Further, the number of shear screws, the geometry of the shear screws, the material composition of the shear screws, or combinations thereof may be varied in additional embodiments of the expandable reamer apparatus to achieve the predetermined threshold value.

The traveling sleeve 128 includes an elongated cylindrical wall and a longitudinal bore forming a fluid passageway through the traveling sleeve 128. The longitudinal ends of the traveling sleeve 128 are open to enable fluid to flow through the traveling sleeve 128 between the open ends thereof. Furthermore, one or more fluid ports 173 (e.g., holes, apertures, etc.) extend laterally through the elongated cylindrical wall of the traveling sleeve 128. For example, fluid ports 173 may be provided proximate to the distal end 165 of the traveling sleeve 128. The distal end 165 of the traveling sleeve 128 may include, within its longitudinal bore, a constricted portion (e.g., a constriction sleeve 129). The constriction sleeve 129 may be used to enable operation of the expandable reamer apparatus 100 to initiate or "trigger" the action of the shear assembly 150. For example, the constriction sleeve 129 may be used to cause a pressure differential within the expandable reamer apparatus 100 in order to reach the predetermined threshold value that may cause the shear assembly 150 to fail. In some embodiments, the constriction sleeve 129 may be integrally formed with the traveling sleeve 128. In other embodiments, the constriction sleeve 129 may be formed separate from the traveling sleeve 128 and by may be coupled to (e.g., within) the traveling sleeve 128. The constriction sleeve 129 may form a portion of the longitudinal bore of the traveling sleeve 128 having a reduced cross-sectional area or diameter as compared to the cross-sectional area or diameter of another portion (e.g., an adjacent portion) of the longitudinal bore of the traveling sleeve 128. For example, the constriction sleeve 129 may be sized to exhibit an orifice (e.g., a longitudinal bore) through the constriction sleeve 129 having an inside diameter of about 1.625 inches (41.275 millimeters) while the traveling sleeve has an inside diameter of about two inches (50.8 millimeters).

In operation, the constriction sleeve 129 may allow fluid to pass through the longitudinal bore of the traveling sleeve 128 at relatively lower fluid flow rates. However, at a relatively higher fluid flow rate, the constriction sleeve 129 may start to limit the amount of fluid passing through the constriction sleeve 129. The constriction of the fluid flow through the fluid passageway of the traveling sleeve 128 by the constriction sleeve 129 may cause an increased hydraulic pressure proximate to a proximal end of the constriction sleeve 129. In other words, the constriction sleeve 129 may cause a pressure differential with a relatively higher pressure at a side of the constriction sleeve in the uphole direction 159 where fluid flow is constricted and a relatively lower pressure at an opposite side of the constriction sleeve in the downhole direction 157 where fluid flow exits the constriction sleeve 129. In some embodiments, the fluid flow path in the longitudinal bore 151 of the tubular body 108 in a downhole direction 157 from the constriction sleeve 129 (e.g., the protect sleeve 121) may comprise a cross-sectional area or diameter greater than the cross-sectional area or diameter of the constriction sleeve 129 to increase the pressure differential between the proximal end of the constriction sleeve 129 and the distal end of the constriction sleeve 129. The pressure at the constriction sleeve 129 (i.e., the pressure differential between a region proximate to the proximal end and a region proximate to the distal end of the constriction sleeve 129) may impart a force in the downhole direction 157 to the constriction sleeve 129 and, thereby, to the traveling sleeve 128.

Figure 14:
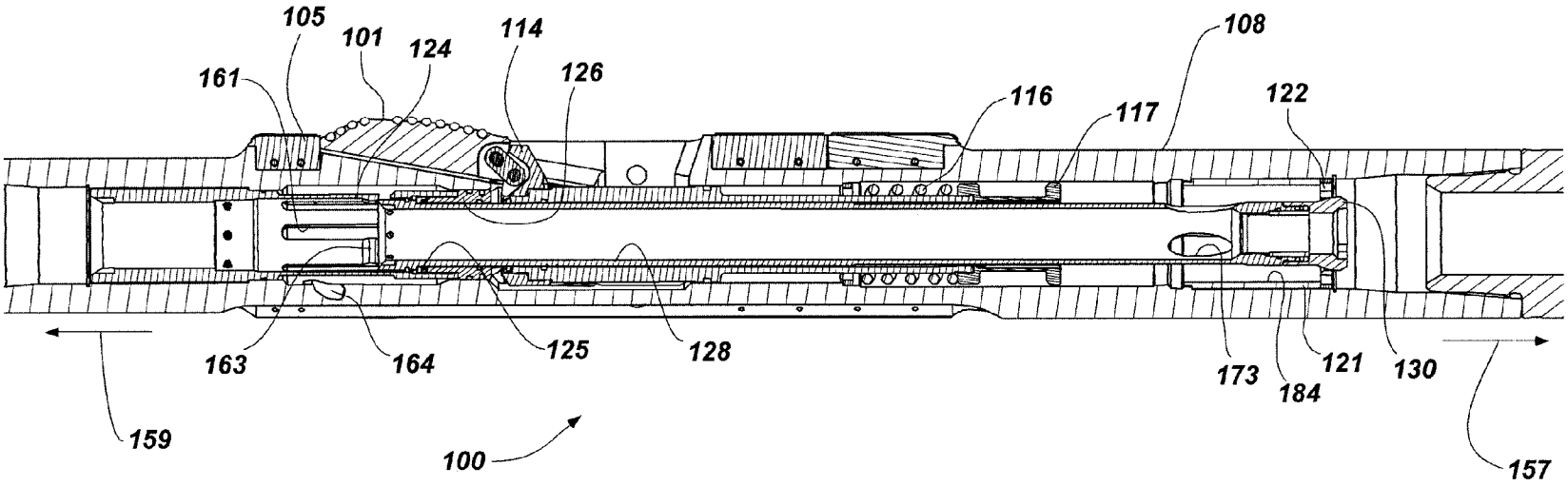
FIG. 14 shows a partial, longitudinal cross-sectional illustration of the expandable reamer apparatus of FIG. 11 in which the traveling sleeve moves toward a lower, retained position while a blade (one depicted) being urged by a push sleeve under the influence of fluid pressure is moved to an extended position.
Figure 15:
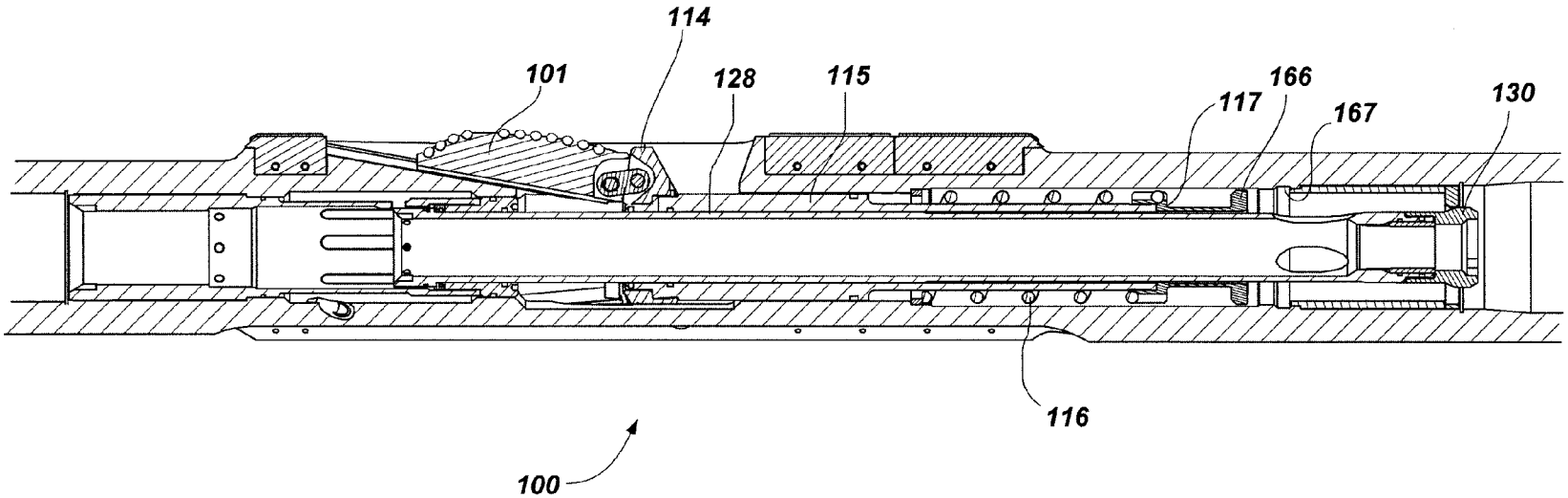
FIG. 15 shows a partial, longitudinal cross-sectional illustration of the expandable reamer apparatus of FIG. 11 in which the blades (one depicted) are retracted into a retracted position by a biasing spring when the fluid pressure is dissipated.

As discussed above, when reaching a predetermined threshold valve, the force imparted to the traveling sleeve 128 at the constriction sleeve 129 by the pressure differential may cause the shear screw or screws 127 to shear. The shearing of shear screws 127 may enable the traveling sleeve 128 along with the coaxially retained seat stop sleeve 130 to axially travel in the longitudinal bore 151 of the tubular body 108 under the influence of the hydraulic pressure. The traveling sleeve 128 may translate in the downhole direction 157 until the traveling sleeve 128 is again axially retained by the uplock sleeve 124 as described above or moves into a lower position as shown in FIGS. 14 and 15. The increased pressure at the constriction sleeve 129 may also direct fluid flow to the fluid ports 173 in the traveling sleeve 128 exerting a force in the uphole direction 159 on the lowlock sleeve 117.

In order to support the traveling sleeve 128 and mitigate vibration effects after the traveling sleeve 128 is axially retained, the seat stop sleeve 130 and the downhole end 165 of the traveling sleeve 128 may be retained in a stabilizer sleeve 122. The stabilizer sleeve 122 may be coupled to the inner bore 151 of the tubular body 108 and retained between a retaining ring 133 and a protect sleeve 121, which is held by an annular lip 171 in the inner bore 151 of the tubular body 108. The retaining ring 133 is held within an annular groove 172 in the inner bore 151 of the tubular body 108. The protect sleeve 121 provides protection from the erosive nature of the hydraulic fluid to the tubular body 108 by allowing hydraulic fluid to flow through fluid ports 173 of the traveling sleeve 128, impinge upon the protect sleeve 121 and past the stabilizer sleeve 122 when the traveling sleeve 128 is retained therein.

After the traveling sleeve 128 travels sufficiently far enough to enable the dogs 166 of the lowlock sleeve 117 to be disengaged from the groove 167 of the tubular body 108, the dogs 166 of the lowlock sleeve 117 being connected to the push sleeve 115 may all move in the uphole direction 159. In order for the push sleeve 115 to move in the uphole direction 159, the differential pressure between the longitudinal bore 151 and the outer surface 111 of the tubular body 108 caused by the hydraulic fluid flow must be sufficient to overcome the restoring force or bias of a spring 116. The spring 116 that resists the motion of the push sleeve 115 in the uphole direction 159, may be retained on an outer surface 175 of the push sleeve 115 between a ring 113 attached in a groove 174 of the tubular body 108 and the lowlock sleeve 117. The push sleeve 115 may axially travel in the uphole direction 159 under the influence of the hydraulic fluid, but is restrained from moving beyond the top lip of the ring 113. The push sleeve 115 may include a seal 137 (e.g., a T-seal) that seals against the traveling sleeve 128 and a wiper seal 141 that seals against the traveling sleeve 128 and push sleeve 115.

In some embodiments, the traveling sleeve 128 may be sealed to prevent fluid flow from exiting the tool through blade passage ports 182, and after triggering, the seal may be maintained.

Figure 10:
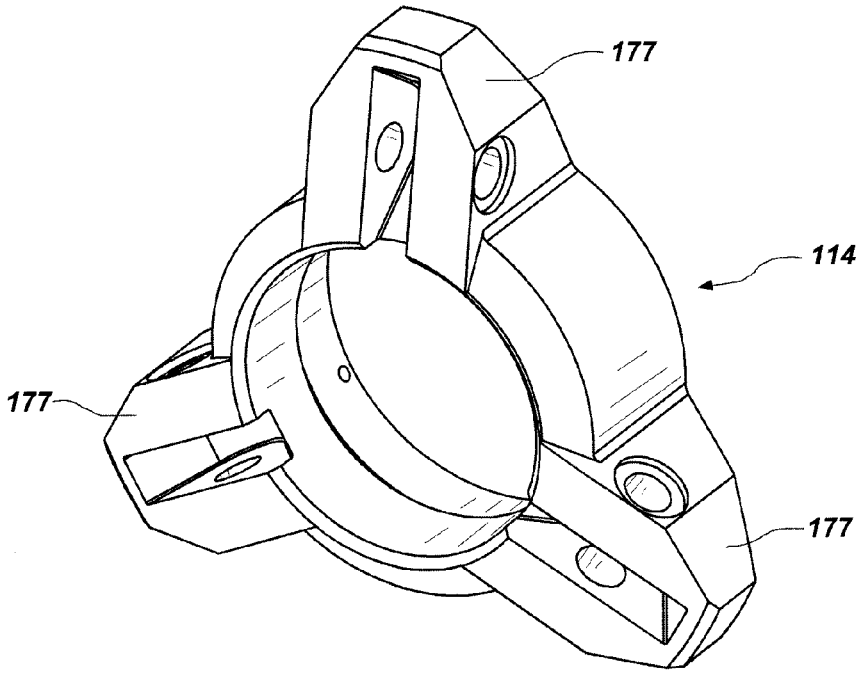
FIG. 10 shows a perspective view of a yoke of an embodiment of an expandable reamer apparatus.

As shown in FIG. 5, the push sleeve 115 includes, at its proximal end, a yoke 114 coupled thereto. The yoke 114 (also shown in greater detail in FIG. 10) includes three aims 177, each arm 177 being coupled to one of the blades 101 by a pinned linkage 178. The arms 177 may include a shaped surface suitable for expelling debris as the blades 101 are retracted toward the retracted position. The shaped surface of the arms 177, in conjunction with the adjacent wall of the cavity of the tubular body 108, may provide included angles of approximately twenty (20) degrees, which may dislodge and remove any packed-in shale, and may further include low friction surface material to prevent sticking by formation cuttings and other debris. The pinned linkage 178 includes a linkage 118 coupling one of the blades 101 to the arm 177, where the linkage 118 is coupled to one of the blades 101 by a blade pin 119 and secured by a retaining ring 142, and the linkage 118 is coupled to the arm 177 by a yoke pin 120. The pinned linkage 178 enables the blades 101 to rotationally transition about the arms 177 of the yoke 114, particularly as the actuating means (e.g., the push sleeve 115, the yoke 114, and the linkage 178) directly transitions the blades 101 between the extended and retracted positions. In some embodiments, the actuating means may directly retract as well as extends the blades 101.

Referring now to FIGS. 2 and 5, in order that the blades 101 may transition between the extended and retracted positions, the blades 101 are each positionally coupled to one of the blade tracks 148 in the tubular body 108. The blade track 148 includes a dovetailed shaped groove 179 that axially extends along the tubular body 108 on a slanted slope 180 having an acute angle with respect to the longitudinal axis $L_8$. Each of the blades 101 include a dovetailed shaped rail 181 that substantially matches the dovetailed shaped groove 179 of the blade track 148 in order to slidably secure the blades 101 to the tubular body 108. When the push sleeve 115 is influenced by the hydraulic pressure, the blades 101 will be extended upward and outward through a blade passage port 182 into the extended position ready for cutting the formation. The blades 101 are pushed along the blade tracks 148 until the forward motion is stopped by the tubular body 108 (e.g., stopped by the upper hard faced pads 105 on the stabilizer block coupled to the tubular body 108). In the upward and outward (i.e., fully extended position), the blades 101 are positioned such that the cutting elements 104 will enlarge a borehole in the subterranean formation by a prescribed amount. When hydraulic pressure provided by drilling fluid flow through expandable reamer apparatus 100 is released, the spring 116 will urge the blades 101 via the push sleeve 115 and the pinned linkage 178 into the retracted position. Should the assembly not readily retract via spring force, the tool may be pulled up the borehole and abutted against a casing shoe. When the tool is pulled against a casing shoe, the shoe may contact the blades 101 helping to urge or force them down the tracks 148, enabling the expandable reamer apparatus 100 to be retrieved from the borehole. In this respect, the expandable reamer apparatus 100 includes a retraction assurance feature to further assist in removing the expandable reamer apparatus from a borehole.

Figure 6:
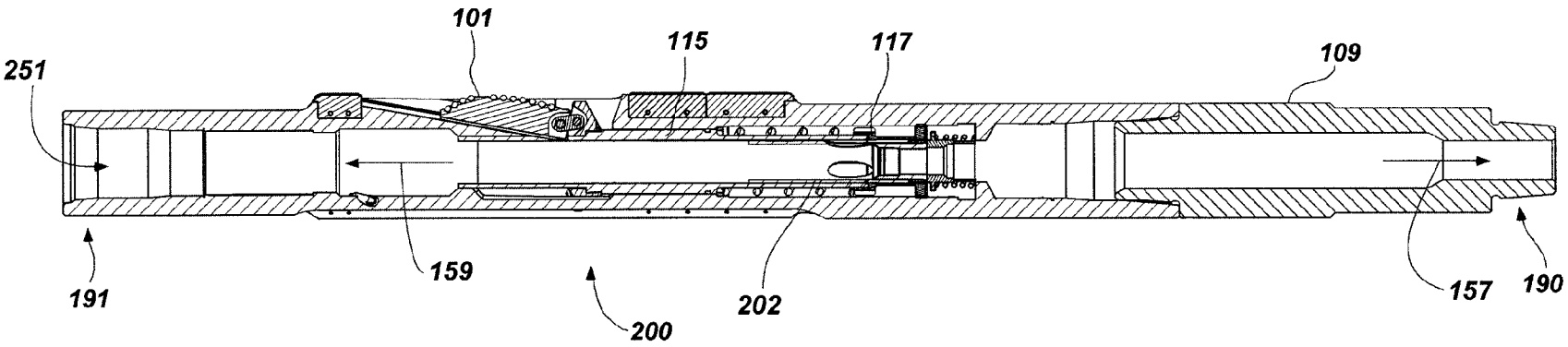
FIG. 6 shows a longitudinal cross-sectional view of an expandable reamer apparatus in accordance with another embodiment of the present invention.

FIG. 6 shows a longitudinal cross-sectional view of an expandable reamer apparatus 200 in accordance with another embodiment of the present invention. The expandable reamer apparatus 200 may be similar to the expandable reamer apparatus 100 shown and described with reference to FIG. 3 and may include a lowlock sleeve 117 and push sleeve 115 coupled to extendable and retractable blades 101. However, the expandable reamer apparatus 200 may include a different actuation mechanism. For example, the expandable reamer apparatus 200 may not include a traveling sleeve and an uplock sleeve and may include a differing sleeve member (e.g., a locking sleeve 202).

Figure 7:
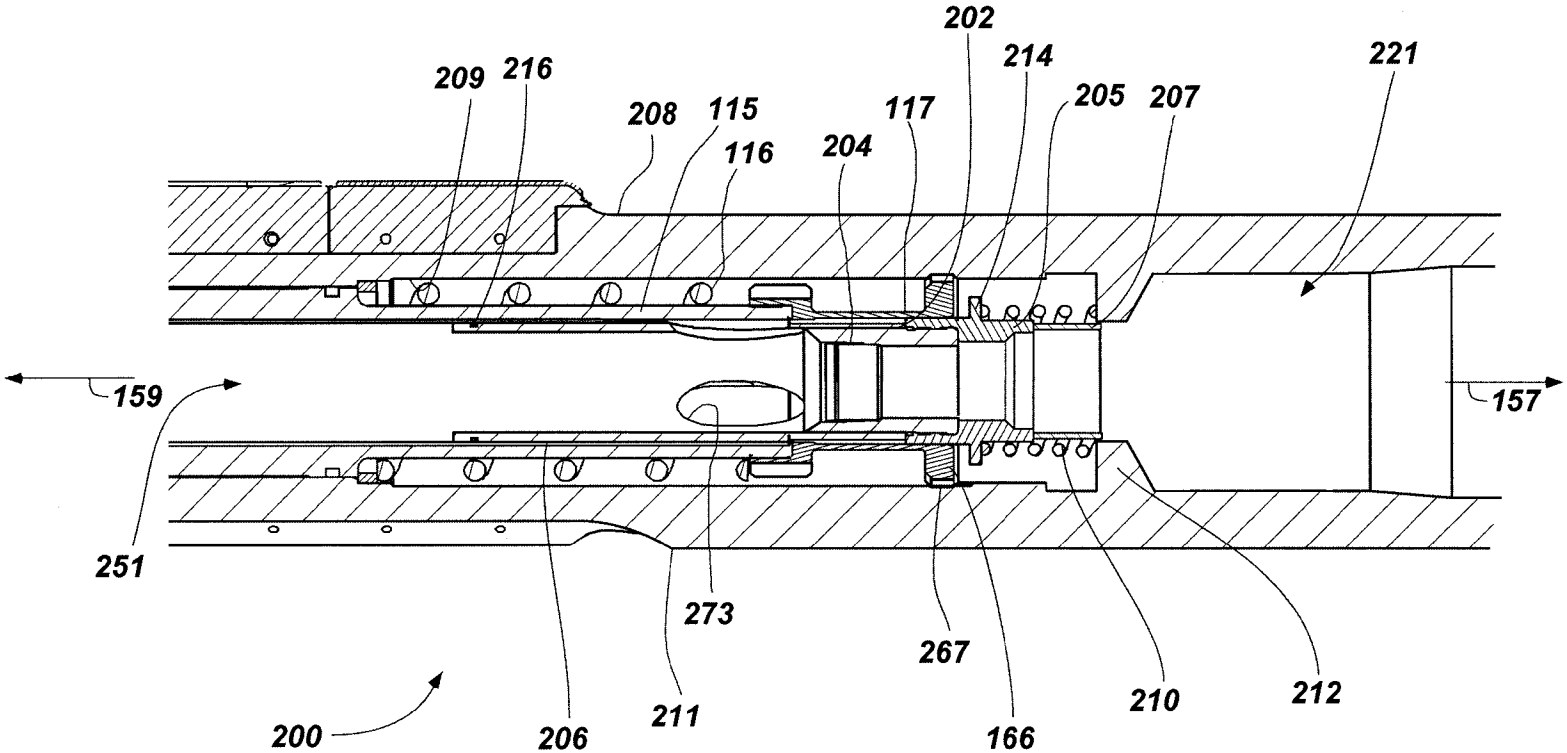
FIG. 7 shows an enlarged cross-sectional view of a portion of the expandable reamer apparatus shown in FIG. 6.
Figure 16:
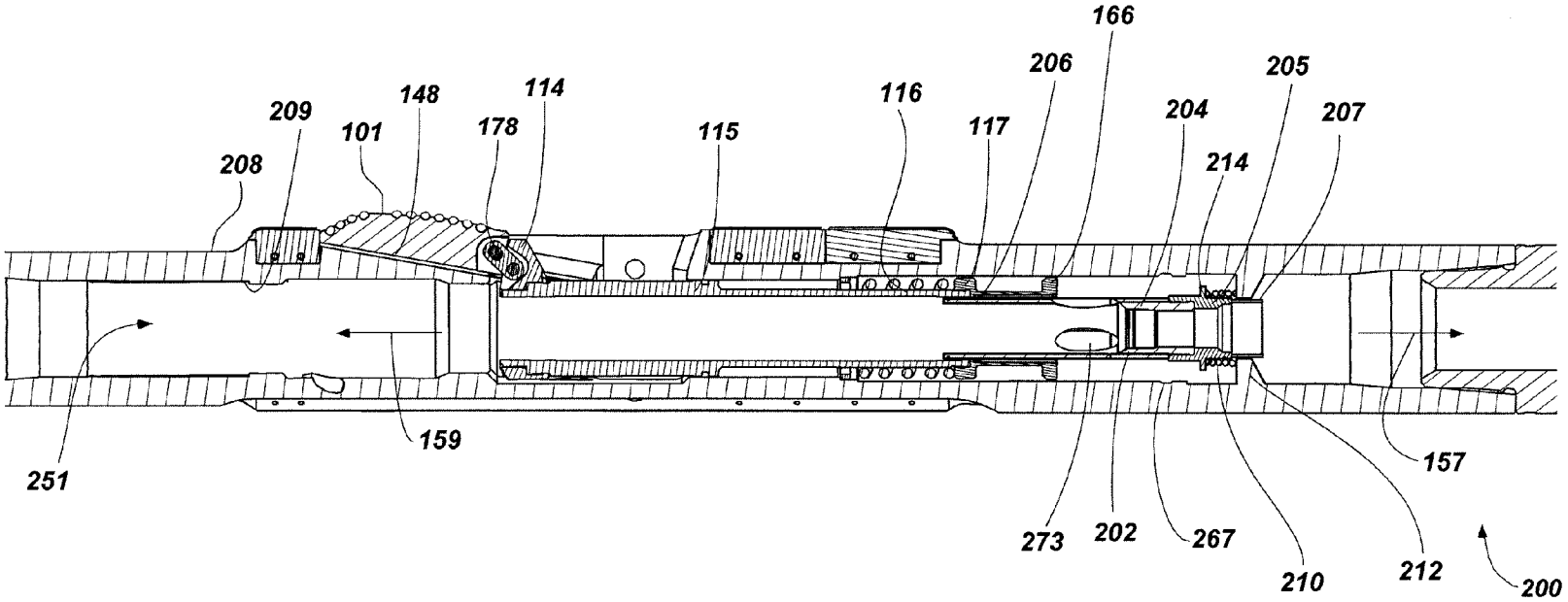
FIG. 16 shows a partial, longitudinal cross-sectional illustration of an embodiment of an expandable reamer apparatus in an expanded position.

As shown in FIG. 7, the expandable reamer apparatus 200 may include a locking sleeve 202 which is movable from a first, initial position, which is shown in FIG. 7 in the downhole direction 157 to a second position shown in FIG. 16. The locking sleeve 202 may form a constricted portion of the longitudinal bore 251 of the expandable reamer apparatus 200. In some embodiments, the locking sleeve 202 may comprise a constriction portion 204, a stopper portion 205, and an extended portion 206. The locking sleeve 202 may be similar to the constriction sleeve 129 shown and described with reference to FIG. 4 and used to enable operation of the expandable reamer apparatus 200 and to facilitate the movement of the blades 101. The locking sleeve 202 may be disposed within the longitudinal bore 251 of the expandable reamer apparatus 200. At relatively lower fluid flow rates of the drilling fluid through the longitudinal bore 251, the locking sleeve 202 may allow fluid to pass therethrough. However, at a relatively higher fluid flow rate, the locking sleeve 202 may start to limit the amount of fluid passing through the locking sleeve 202. The constriction of the fluid flow through the fluid passageway formed in the longitudinal bore 251 of the expandable reamer apparatus 200 by the constriction portion 204 of the locking sleeve 202 may cause an increased hydraulic pressure proximate to the locking sleeve 202. The increased pressure at a proximal end of the constriction portion 204 of the locking sleeve 202 and a decreased pressure at a distal end of the constriction portion 204 of the locking sleeve 202 may form a pressure differential and may impart a force in the downhole direction 157 to the locking sleeve 202. The force may translate the locking sleeve 202 in the downhole direction 157. In some embodiments, the fluid flow path in the longitudinal bore 251 of a tubular body 208 in a downhole direction 157 from the constriction portion 204 of the locking sleeve 202 (e.g., a downhole portion 221) may comprise a cross-sectional area or diameter greater than the cross-sectional area or diameter of the constriction portion 204 to increase the pressure differential between the proximal end of the constriction portion 204 and the distal end of the constriction portion 204. The increased pressure at the constriction portion 204 of the locking sleeve 202 may also direct fluid flow to fluid ports 273 formed in the locking sleeve 202 to exert a force in the uphole direction 159 on the lowlock sleeve 117.

After the locking sleeve 202 travels sufficiently far enough from the initial position in the downhole direction 157 to enable the dogs 166 of the lowlock sleeve 117 to be disengaged from a groove 267 of the tubular body 208, the dogs 166 of the lowlock sleeve 117 coupled to the push sleeve 115 may all move in the uphole direction 159. In order for the push sleeve 115 to move in the uphole direction 159, the differential pressure between the longitudinal bore 251 and an outer surface 211 of the tubular body 208 caused by the hydraulic fluid flow must be sufficient to overcome the restoring force or bias of the spring 116.

A biasing element 210 such as, for example, a spring, may be used to bias the locking sleeve 202 to the initial position. The biasing element 210 may be disposed in the longitudinal bore 251 of the expandable reamer apparatus 200. The biasing element 210 may abut against a portion of the locking sleeve 202 and against a portion of the tubular body 208 to apply a force against the locking sleeve 202 that urges the locking sleeve 202 toward the initial position. For example, the biasing element 210 may abut against a shoulder 212 formed in the tubular body 208 and may abut against the locking sleeve 202 at a shoulder 214 formed on the stopper portion 205 of the locking sleeve 202. In some embodiments, the biasing element 210 may be coupled to a portion of the tubular body 208 or a portion of the locking sleeve 202. In other embodiments, the biasing element 210 may be retained by a groove foamed in the tubular body 208 or a groove formed in the locking sleeve 202.

As the locking sleeve 202 moves in the downhole direction 157, the stopper portion 205 of the locking sleeve 202 may abut a portion of the shoulder 212 formed in the tubular body 208 and the shoulder 212 may restrain the locking sleeve 202 from moving beyond the shoulder 212. The locking sleeve 202 may further include a guide portion 207 extending in a downhole direction 157 from the stopper portion 205. The guide portion 207 may be received within the orifice formed by the shoulder 212 of the tubular body 208 and may axially align and guide the movement of the locking sleeve 202 in the downhole direction 157 within the tubular body 208.

The extended portion 206 of the locking sleeve 202 may extend along the longitudinal bore 251 of the tubular body 208. The extended portion 206 may also extend along a portion of the push sleeve 115 and the lowlock sleeve 117 to prevent fluid flow from flowing between the push sleeve 115 and the lowlock sleeve 117 and an inner wall 209 of the tubular member 208 when the push sleeve 115 and the lowlock sleeve 117 are displaced in the uphole direction 159. In some embodiments, the extended portion 206 of the locking sleeve 202 may include a seal 216 disposed between the locking sleeve 202 and the push sleeve 115 to prevent fluid from flowing between the locking sleeve 202 and the push sleeve 115.

Figure 12:
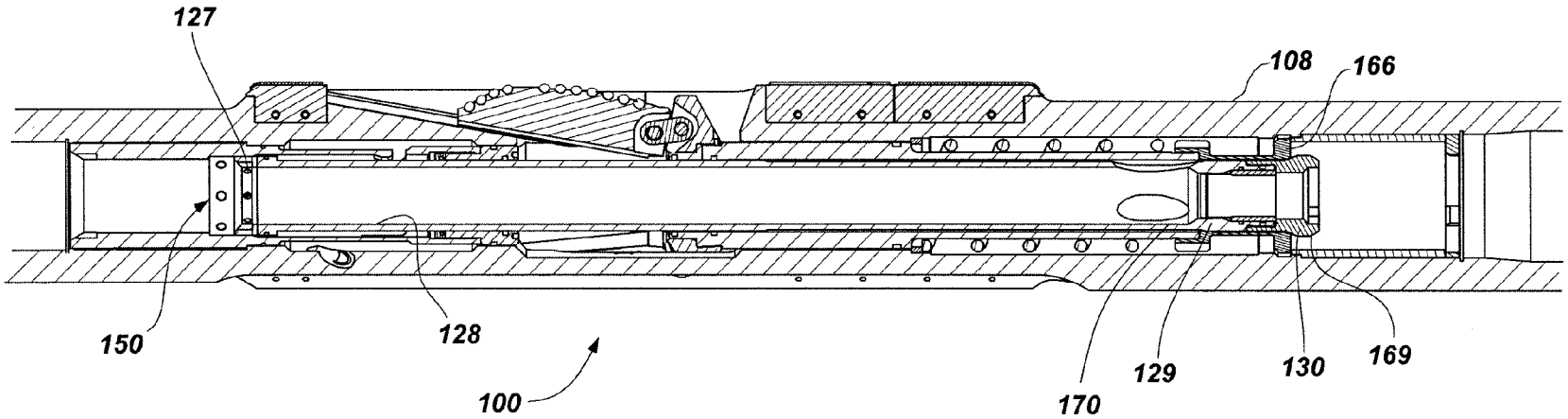
FIG. 12 shows a partial, longitudinal cross-sectional illustration of the expandable reamer apparatus of FIG. 11 in the initial tool position prior to actuation of the blades.

Referring now to FIGS. 11 through 15, the expandable reaming apparatus 100 is now described in terms of its operational aspects. The expandable reamer apparatus 100 may be installed in a bottomhole assembly above a pilot bit and, if included, above or below the measurement while drilling (MWD) device and incorporated into a rotary steerable system (RSS) and rotary closed loop system (RCLS), for example. Before "triggering" the expandable reamer apparatus 100 to the expanded position, the expandable reamer apparatus 100 is maintained in an initial, retracted position as shown in FIG. 11. For example, the traveling sleeve 128 within the expandable reamer apparatus 100 prevents inadvertent extension of blades 101, as previously described, and is retained by the shear assembly 150 with shear screws 127 secured to the uplock sleeve 124 which is attached to the tubular body 108. While the traveling sleeve 128 is held in the initial position, the blade actuating means is prevented from directly actuating the blades 101 whether acted upon by biasing forces or hydraulic forces. The traveling sleeve 128 has, on its distal end, an enlarged end piece (e.g., the seat stop sleeve 130). This larger diameter seat stop sleeve 130 holds the dogs 166 of the lowlock sleeve 117 in a secured position, preventing the push sleeve 115 from moving upward under affects of differential pressure and activating the blades 101. The latch dogs 166 lock the latch or expandable detent 168 into a groove 167 in the longitudinal bore 151 of the tubular body 108. When it is desired to trigger the expandable reamer apparatus 100, the rate of flow of drilling fluid through the reamer apparatus 100 may be increased to, in turn, increase the hydraulic pressure at the constriction sleeve 129 and to exert a force (e.g., a force due to a pressure differential) against the constriction sleeve 129. The increased pressure may cause the traveling sleeve 128 to move from an initial position shown in FIG. 11 in the downhole direction 157 to a downhole position as shown in FIG. 12.

Referring now to FIG. 12, at a predetermined pressure differential set by the number and individual shear strengths of the shear screws 127 installed initially in the expandable reamer apparatus 100, the shear screws 127 will fail in the shear assembly 150 and enable the traveling sleeve 128 to unseal and move downward responsive to the increased pressure at the constriction sleeve 129. As the traveling sleeve 128 with the larger diameter 169 of the seat stop sleeve 130 moves downward, the latch dogs 166 of the lowlock sleeve 117 are free to move inward toward the smaller diameter 170 of the traveling sleeve 128 and become free of the tubular body 108.

Figure 13:
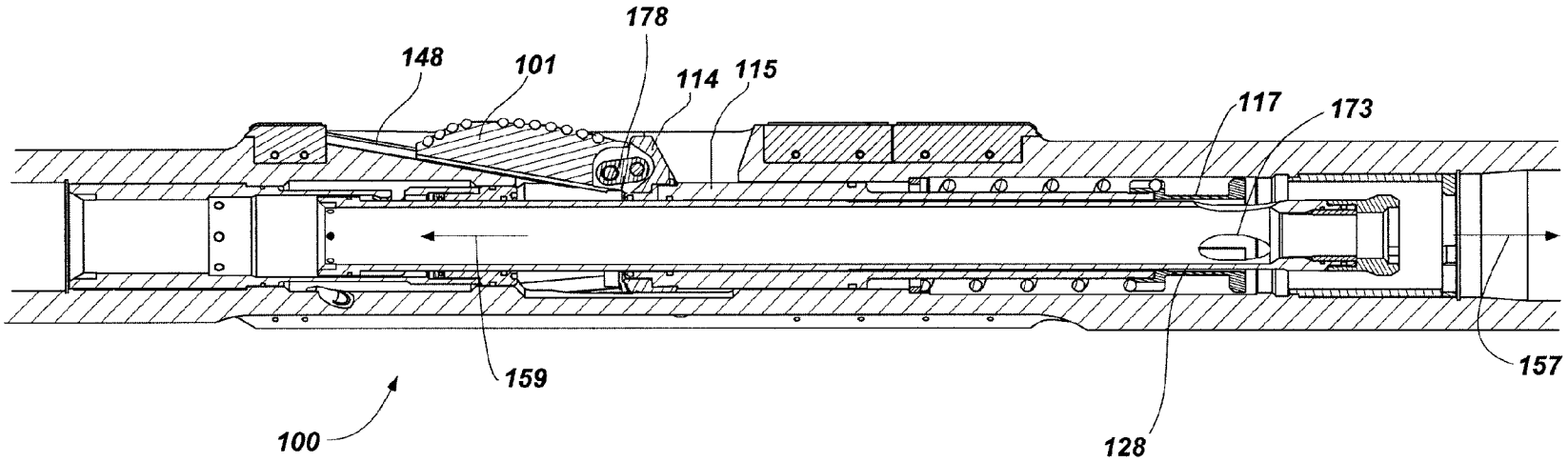
FIG. 13 shows a partial, longitudinal cross-sectional illustration of the expandable reamer apparatus of FIG. 11 in which a shear assembly is triggered as pressure is accumulated and a traveling sleeve begins to move down within the apparatus, leaving the initial tool position.

Thereafter, as illustrated in FIG. 13, the lowlock sleeve 117 coupled to the pressure-activated push sleeve 115 may move in the uphole direction 159 under fluid pressure influence through the fluid ports 173 as the traveling sleeve 128 moves in the downhole direction 157. As the fluid pressure is increased the biasing force of the spring is overcome enabling the push sleeve 115 to move in the uphole direction 159. The push sleeve 115 is attached to the yoke 114 which is attached by pins and linkage 178 to the three blades 101, which are now moved upwardly by the push sleeve 115. In moving upward, the blades 101 each follow a ramp or track 148 to which they are mounted (e.g., via a type of modified square dovetail groove 179 (FIG. 2)).

As shown in FIG. 14, the stroke of the blades 101 may be stopped in the fully extended position by upper hard faced pads 105 on the stabilizer block, for example. Optionally, as mentioned herein above, a customized stabilizer block may be assembled to the expandable reamer apparatus 100 prior to drilling in order to adjust and limit the extent to which the blades 101 may extend. In some embodiments, the thickness of the blades 101 (i.e., a dimension of the blades 101 taken in a lateral direction of the expandable reamer apparatus 100) may be varied in order to provide a desired borehole diameter during the reaming process. With the blades 101 in the extended position, reaming a borehole may commence.

As reaming takes place with the expandable reamer apparatus 100, the lower and mid hard face pads 106, 107 (FIG. 1) may help to stabilize the tubular body 108 as the cutting elements 104 of the blades 101 ream a larger borehole and the upper hard face pads 105 (FIG. 1) may also help to stabilize the top of the expandable reamer 100 when the blades 101 are in the retracted position.

After the traveling sleeve 128 moves downward, it comes to a stop with the fluid ports 173 in the traveling sleeve 128 exiting against the inside wall 184 of the hard faced protect sleeve 121, which helps to prevent or minimize erosion damage from drilling fluid flow impinging thereupon. The upper end of the traveling sleeve 128 may become trapped or locked between the ears 163 of the uplock sleeve 124 and the shock absorbing member 125 of the seal sleeve 126 and the lower end of the traveling sleeve 128 is laterally stabilized by the stabilizer sleeve 122.

When drilling fluid pressure is released, the spring 116 will help drive the lowlock sleeve 117 and the push sleeve 115 with the attached blades 101 back downwardly and inwardly substantially to their original initial position (e.g., the retracted position), as shown in FIG. 15. However, since the traveling sleeve 128 has moved to a downward locked position, the larger diameter seat stop sleeve 130 will no longer hold the dogs 166 out and in the groove 167, and, thus, the latch or lowlock sleeve 117 stays unlatched for subsequent operation.

Whenever the flow rate of the drilling fluid passing through the traveling sleeve 128 is elevated to or beyond a selected flow rate value, the push sleeve 115 with the yoke 114 and blades 101 may move upward with the blades 101 following the tracks 148 to again ream the prescribed larger diameter in a borehole. Whenever the flow rate of the drilling fluid passing through the traveling sleeve 128 is below a selected flow rate value (i.e., the differential pressure falls below the restoring force of the spring 116), the blades 101 may retract, as described above, via the spring 116. In this manner, the expandable reamer apparatus 100 may move the blades 101 between the retracted position and the expanded position in a repetitive manner (e.g., an infinite amount of times). The expandable reamer apparatus 100 may also enable drilling fluid to flow through the tubular body 108 and to exit the tubular body 108 through the distal end 190 (FIG. 3) after the blades 101 are expanded or retracted (e.g., after elements of the expandable reamer apparatus 100 are moved from the initial position).

Referring now to FIGS. 7 and 16, the expandable reaming apparatus 200 is now described in terms of its operational aspects. The expandable reaming apparatus 200 may operate in a similar manner to that of the expandable reaming apparatus 100 shown and described with reference to FIGS. 11 through 15. Before "triggering" the expandable reamer apparatus 200 to the expanded position, the expandable reamer apparatus 200 is maintained in an initial, retracted position as shown in FIG. 7. While the locking sleeve 202 is biased in the initial position by the biasing element 210, the blade actuating means (e.g., the push sleeve 115) is prevented from directly actuating the blades 101 whether acted upon by biasing forces or hydraulic forces. The locking sleeve 202 has, on its distal end, an enlarged end piece (e.g., the stopper portion 205). This larger diameter stopper portion 205 holds the dogs 166 of the lowlock sleeve 117 in a secured position, preventing the push sleeve 115 from moving upward under affects of differential pressure and activating the blades 101. The latch dogs 166 lock the latch or expandable detent 168 into the groove 267 in the longitudinal bore 251 of the tubular body 208. When it is desired to trigger the expandable reamer apparatus 200, the rate of flow of drilling fluid through the reamer apparatus 200 is increased to increase the hydraulic pressure at the constriction portion 204 of the locking sleeve 202 and to exert a force (e.g., a force due to a pressure differential) against the locking sleeve 202 and translate the locking sleeve 202 in the downhole direction 157.

As shown in FIG. 16, the locking sleeve 202 may travel sufficiently far enough from the initial position in the downhole direction 157 to enable the dogs 166 of the lowlock sleeve 117 to be disengaged from the groove 267 of the tubular body 208. The lowlock sleeve 117 coupled to the pressure-activated push sleeve 115 may move in the uphole direction 159 under fluid pressure influence through the fluid ports 273. As the fluid pressure is increased by the increased fluid flow the biasing force of the spring is overcome enabling the push sleeve 115 to move in the uphole direction 159. The push sleeve 115 is attached to the yoke 114 that is attached by pins and linkage 178 to the blades 101, which are now moved upwardly by the push sleeve 115. In moving upward, the blades 101 each follow a ramp or track 148 to which they are mounted (e.g., via a type of modified square dovetail groove 179 (FIG. 2)).

After the locking sleeve 202 moves in the downhole direction 157 against the force of the biasing element 210, the stopper portion 205 may abut the shoulder 212 of the tubular body 208. In other embodiments, the stopper portion 205 may not abut the shoulder 212 as movement of the locking sleeve 202 may be stopped by the force of the biasing element 210 or the biasing element 210 itself.

Whenever the flow rate of the drilling fluid passing through the locking sleeve 202 is decreased below a selected flow rate value, the biasing element 210 may return the locking sleeve 202 to the initial position shown in FIG. 7. As the locking sleeve 202 returns to the initial position, the lowlock sleeve 117 and the dogs 166 may return to the initial position and the locking sleeve 202 may again secure the dogs 166 in the groove 267 of the tubular body 208. The push sleeve 115 with the yoke 114 may also return to the initial position and the blades 101 may return to the retracted position.

Whenever the flow rate of the drilling fluid passing through locking sleeve 202 is elevated to or beyond a selected flow rate value, the locking sleeve 202 may again move in the downhole direction 157 releasing the dogs 166 of the lowlock sleeve 117 as shown in FIG. 16. The push sleeve 115 with the yoke 114 and blades 101 may then move upward with the blades 101 following the tracks 148 to again ream the prescribed larger diameter in a borehole. In this manner, the expandable reamer apparatus 200 may move the blades 101 between the retracted position and the expanded position in a repetitive manner (e.g., an infinite amount of times). The expandable reamer apparatus 200 may also enable drilling fluid to flow through the tubular body 208 and to exit the tubular body 208 through the distal end 190 (FIG. 6) after the blades 101 are expanded or retracted (e.g., after elements of the expandable reamer apparatus 200 are moved from the initial position).

One advantage of embodiments of the present invention is that, after the sleeve member is caused to move to the downhole position and the blades are initially extended, the blades may retract and the sleeve member will return to the initial position securing the blades in the retracted position. In such embodiments, for example, drilling with a pilot bit attached to the downhole end of the reamer apparatus may resume while drilling fluid is pumped through the reamer apparatus to the pilot bit without causing the blades to again move into the extended position (i.e., without reaming), as long as the flow rate is maintained below that required to move the sleeve member in the downhole direction. In other words, the drilling fluid may be caused to flow through the sleeve member at a flow rate below the flow rate required to move the sleeve member in the downhole direction and to unsecure the dogs of the lowlock sleeve while drilling a bore with a pilot bit attached to the reamer apparatus and while the blades are retracted. Such processes may not be feasible with ball and ball trap actuation devices, such as those disclosed in U.S. Patent Application Publication No. US 2008/0128175 A1.

While particular embodiments of the invention have been shown and described, numerous variations and other embodiments will occur to those skilled in the art. Accordingly, it is intended that the invention only be limited in terms of the appended claims and their legal equivalents.

Additional non-limiting example Embodiments are described below.

Embodiment 1: An expandable apparatus for use in a subterranean borehole, comprising: a tubular body having at least one opening in a wall of the tubular body; at least one member positioned within the at least one opening in the wall of the tubular body, the at least one member configured to move between a retracted position and an extended position; and a sleeve member disposed in the tubular body and having a longitudinal bore forming a fluid passageway through the sleeve member to allow fluid to flow therethrough, the sleeve member comprising a constricted portion of the longitudinal bore having a cross-sectional area less than a cross-sectional area of an adjacent portion of the longitudinal bore, the constricted portion constricting the fluid passageway through the sleeve member to enable displacement of the sleeve member in a downhole direction responsive to a selected flow rate and wherein the sleeve member is configured to selectively retain the at least one member in the retracted position.

Embodiment 2: The expandable apparatus of Embodiment 1, wherein the sleeve member is axially retained in an initial position by a shear assembly within the tubular body.

Embodiment 3: The expandable apparatus of Embodiment 2, wherein the shear assembly comprises at least one shear screw, the at least one shear screw configured to retain the sleeve member in the initial position until the selected flow rate reaches a predetermined value.

Embodiment 4: The expandable apparatus of any one of Embodiments 1 through 3, further comprising a push sleeve disposed within the longitudinal bore of the tubular body and coupled to the at least one member, the push sleeve configured to move the at least one member from the retracted position to the extended position responsive to a flow rate of drilling fluid passing through the longitudinal bore and wherein the sleeve member comprises a traveling sleeve positioned within the longitudinal bore of the tubular body and partially within the push sleeve, the traveling sleeve configured to secure the push sleeve from axial movement within the tubular body in an initial position.

Embodiment 5: The expandable apparatus of Embodiment 4, wherein the traveling sleeve is configured to selectively retain the push sleeve in the initial position and to release the push sleeve when displaced in the downhole direction in a triggered position.

Embodiment 6: The expandable apparatus of any one of Embodiments 1 through 5, wherein the sleeve member comprises a completely integral feature responsive to a selected flow rate through the tubular body for selectively retaining the at least one member in the retracted position.

Embodiment 7: The expandable apparatus of any one of Embodiments 1 through 6, wherein the sleeve member is biased in the initial position by a spring.

Embodiment 8: The expandable apparatus of any one of Embodiments 1 through 7, wherein the expandable apparatus comprises at least one of an expandable reamer apparatus and an expandable stabilizer apparatus.

Embodiment 9: An expandable apparatus for use in a subterranean borehole, comprising: a tubular body having at least one opening extending between a longitudinal bore of the tubular body and an outer surface of the tubular body, the longitudinal bore forming a fluid passageway through the tubular body; at least one member positioned within the at least one opening of the tubular body, the at least one member configured to move between a retracted position and an extended position; and a sleeve member disposed within the longitudinal bore and biased in an initial position, the sleeve member comprising a constricted portion of the fluid passageway, wherein the sleeve member is configured to move in a downhole direction responsive to an increased pressure in the sleeve member formed by the constricted portion of the fluid passageway and wherein the sleeve member is configured to selectively retain the at least one member in the retracted position.

Embodiment 10: The expandable apparatus of Embodiment 9, wherein the sleeve member is biased in the initial position by a spring.

Embodiment 11: The expandable apparatus of Embodiments 9 or 10, further comprising a locking member within the tubular body engaging a portion of the tubular body to retain the at least one member in the retracted position, wherein the sleeve member retains the locking member in engagement with the tubular body in the initial position and enables the locking sleeve to disengage with the tubular body in a triggered position.

Embodiment 12: The expandable apparatus of any one of Embodiments 9 through 11, wherein the sleeve member comprises a completely integral feature responsive to a fluid flow through the tubular body for selectively retaining the at least one member in the retracted position.

Embodiment 13: The expandable apparatus of any one of Embodiments 9 through 12, wherein the expandable apparatus comprises at least one of an expandable reamer apparatus and an expandable stabilizer apparatus.

Embodiment 14: An expandable apparatus for use in a subterranean borehole, comprising: a tubular body having at least one opening in a wall of the tubular body; and at least one member positioned within the at least one opening in the wall of the tubular body, the at least one member configured to move between a retracted position and an extended position and wherein the expandable apparatus is configured to move the at least one member between the expanded position and the retracted position an infinite amount of times.

Embodiment 15: The expandable apparatus of Embodiment 14, wherein the expandable apparatus is configured to enable drilling fluid to flow through the tubular body and out a distal end of the tubular body after moving the at least one member to the expanded position.

Embodiment 16: The expandable apparatus of Embodiments 14 or 15, wherein the expandable apparatus comprises at least one of an expandable reamer apparatus and an expandable stabilizer apparatus.

Embodiment 17: The expandable apparatus of Embodiment 16, wherein the expandable apparatus comprises the expandable reamer apparatus and the at least one member comprising at least one blade having at least one cutting element disposed thereon.

Embodiment 18: The expandable apparatus of Embodiment 16, wherein the expandable apparatus comprises the expandable stabilizer apparatus and the at least one member comprising at least one stabilizer block.

Embodiment 19: A method of moving at least one member of an expandable apparatus, comprising: expanding at least one member of an expandable apparatus responsive to a fluid flow through the expandable apparatus; retracting the at least one member of the expandable apparatus responsive to the fluid flow through the expandable apparatus; and repeating the expanding and retracting of the at least one member an infinite amount of times.

Embodiment 20: The method of Embodiment 19, further comprising flowing drilling fluid through the expandable apparatus and out a distal end of the expandable apparatus after expanding the at least one member.

Embodiment 21: The method of Embodiments 19 or 20, wherein expanding at least one member of an expandable apparatus responsive to a fluid flow through the expandable apparatus further comprises stabilizing a bottom hole assembly in a borehole with the at least one member while the at least one member is expanded.

Embodiment 22: The method of any one of Embodiments 19 through 21, wherein expanding at least one member of an expandable apparatus responsive to a fluid flow through the expandable apparatus further comprises reaming a borehole with at least one cutting element on the at least one member while the at least one member is expanded.

Embodiment 23: A method for triggering an expandable apparatus for use in a subterranean borehole, comprising: forming a constriction in a fluid flow path extending through a sleeve member at least partially disposed in a tubular body of an expandable apparatus; supplying drilling fluid through the fluid flow path at a selected flow rate; increasing a pressure of fluid within the sleeve member responsive to a restriction of the fluid flow path through the sleeve member by the constriction; moving the sleeve member in a downhole direction from a first position to a second position responsive to the increase of the pressure of the fluid within the sleeve member; and moving at least one member of the expandable apparatus from a retracted position to an extended position responsive to the movement of the sleeve member from the first position to the second position.

Embodiment 24 : The method of Embodiment 23, wherein moving at least one member of the expandable apparatus from a retracted position to an extended position comprises moving the at least one member of the expandable apparatus from the retracted position to the extended position responsive to the increase in the pressure of the fluid within the sleeve member.

Embodiment 25: The method of Embodiments 23 or 24, wherein moving the sleeve member in a downhole direction from a first position to a second position further comprises disengaging a locking member retaining the at least one member of the expandable apparatus in a retracted position.

Embodiment 26: The method of any one of Embodiments 23 through 25, further comprising shearing the shear screws of a shear assembly retaining the sleeve member in the tubular body in the first position responsive to the restriction of the fluid flow path through the sleeve member by the constriction.

Embodiment 27: The method of any one of Embodiments 23 through 26, further comprising biasing the sleeve member to return to the first position responsive to a decrease in the pressure of the fluid in the sleeve member.

Embodiment 28: The method of any one of Embodiments 23 through 27, further comprising reaming the borehole with at least one cutting element on the at least one member while the at least one member is in the extended position after moving the at least one member from the retracted position to the extended position.

Embodiment 29: The method of Embodiment 28, further comprising biasing the at least one member toward the retracted position.

Embodiment 30: The method of Embodiments 28 or 29, further comprising: decreasing the pressure of the fluid within the sleeve member to enable the at least one member to return to the retracted position from the extended position; further drilling the borehole with a pilot bit while the at least one member is in the retracted position after reaming the borehole.

Embodiment 31: The method of any one of Embodiments 28 through 30, further comprising forming the at least one member to have a predetermined thickness to provide a desired borehole diameter during the reaming process.

Embodiment 32: The method of any one of Embodiments 19 through 22, wherein repeating the expanding and retracting of the at least one member comprises repeating the expanding and retracting of the at least one member without removing the expandable apparatus from a subterranean formation.

What is claimed is:

1. An expandable apparatus for use in a subterranean borehole, comprising:

a tubular body having a longitudinal bore and at least one opening in a wall of the tubular body;

at least one member positioned within the at least one opening in the wall of the tubular body, the at least one member configured to move between a retracted position and an extended position; and a sleeve member disposed in the tubular body and having a longitudinal bore forming a fluid passageway through the sleeve member to allow fluid to flow therethrough, the sleeve member comprising a constricted portion of the longitudinal bore having a cross-sectional area less than a cross-sectional area of an adjacent portion of the longitudinal bore, the constricted portion constricting the fluid passageway through the sleeve member to enable displacement of the sleeve member in a downhole direction responsive to a selected flow rate to a displaced position, wherein:

in an initial position, the sleeve member retains the at least one member in the retracted position by forcing a locking member coupled to the at least one member into engagement with the tubular body;

in the displaced position the sleeve member allows the at least one member to move to the extended position by enabling the locking member to disengage with the tubular body; and the sleeve member is biased in an uphole direction in order to return the sleeve to the initial position from the displaced position to reengage the locking member with the tubular body; and the sleeve member further comprises a guide portion configured to travel along a shoulder formed within the longitudinal bore of the tubular body when the sleeve member is moved between the initial position and the displaced portion.

2. The expandable apparatus of claim 1, wherein the sleeve member is axially retained in the initial position by a shear assembly within the tubular body.

3. The expandable apparatus of claim 2, wherein the shear assembly comprises at least one shear screw, the at least one shear screw configured to retain the sleeve member in the initial position until the selected flow rate reaches a predetermined value.

4. The expandable apparatus of claim 1, further comprising a push sleeve disposed within the longitudinal bore of the tubular body and coupled to the at least one member, the push sleeve configured to move the at least one member from the retracted position to the extended position responsive to a flow rate of drilling fluid passing through the longitudinal bore and wherein the sleeve member comprises a traveling sleeve positioned within the longitudinal bore of the tubular body and at least partially within the push sleeve, the traveling sleeve configured to secure the push sleeve from axial movement within the tubular body in the initial position.

5. The expandable apparatus of claim 4, wherein the traveling sleeve is configured to selectively retain the push sleeve in the initial position and to release the push sleeve when displaced in the downhole direction in the displaced position.

6. The expandable apparatus of claim 1, wherein the sleeve member is biased in the initial position by a spring.

7. The expandable apparatus of claim 1, wherein the expandable apparatus comprises at least one of an expandable reamer apparatus and an expandable stabilizer apparatus.

8. An expandable apparatus for use in a subterranean borehole, comprising:

a tubular body having at least one opening in a wall of the tubular body;

at least one member positioned within the at least one opening in the wall of the tubular body, the at least one member configured to move between a retracted position and an extended position and wherein the expandable apparatus is configured to repeatedly move the at least one member between the expanded position and the retracted position;

a locking member coupled to the at least one member within the tubular body and engaging a portion of the tubular body to retain the at least one member in the retracted position; and a sleeve member disposed in the tubular body and having a longitudinal bore forming a fluid passageway through the sleeve member to allow fluid to flow therethrough, the sleeve member comprising a constricted portion of the longitudinal bore having a cross-sectional area less than a cross-sectional area of an adjacent portion of the longitudinal bore, wherein the sleeve member retains the locking member in engagement with the tubular body in an initial position, enables the locking member to disengage with the tubular body in a triggered position, and is biased in an uphole direction in order to reengage the locking member with the tubular body alter the sleeve member is returned to the initial position from the triggered position, and wherein the sleeve member further comprises a guide portion configured to travel along a shoulder formed within the longitudinal bore of the tubular body when the sleeve member is moved between the initial position and the triggered position.

9. The expandable apparatus of claim 8, wherein the expandable apparatus comprises at least one of an expandable reamer apparatus and an expandable stabilizer apparatus.

10. The expandable apparatus of claim 9, wherein the expandable apparatus comprises the expandable reamer apparatus and the at least one member comprising at least one blade having at least one cutting element disposed thereon.

11. The expandable apparatus of claim 9, wherein the expandable apparatus comprises the expandable stabilizer apparatus and the at least one member comprising at least one stabilizer block.

12. A method of moving at least one member of an expandable apparatus, comprising:

guiding a sleeve in a downhole direction with a guide portion of the sleeve member that travels along a shoulder formed within a tubular body of the expandable apparatus from a first position to a second position;

disengaging a locking member coupled to the at least one member of the expandable apparatus, the locking member retaining the at least one member of the expandable apparatus in an initial position;

expanding the at least one member of the expandable apparatus from the initial position to an expanded position responsive to a fluid flow through the expandable apparatus;

retracting the at least one member of the expandable apparatus from the expanded position to the initial position responsive to the fluid flow through the expandable apparatus;

guiding the sleeve member in an uphole direction with the guide portion of the sleeve member from the second position to the first position;

after expanding and retracting the at least one member, engaging the locking member coupled to the at least one member in order to retain the at least one member in the initial position, and repeating the expanding and retracting of the at least one member.

13. The method of claim 12, wherein repeating the expanding and retracting of the at least one member comprises repeating the expanding and retracting of the at least one member without removing the expandable apparatus from a subterranean formation.

14. The method of claim 12, further comprising flowing drilling fluid through the expandable apparatus and out a distal end of the expandable apparatus after expanding the at least one member.

15. The method of claim 12, wherein expanding at least one member of an expandable apparatus responsive to a fluid flow through the expandable apparatus further comprises stabilizing a bottom hole assembly in a borehole with the at least one member while the at least one member is expanded.

16. The method of claim 12, wherein expanding at least one member of an expandable apparatus responsive to a fluid flow through the expandable apparatus further comprises reaming a borehole with at least one cutting element on the at least one member while the at least one member is expanded.

17. A method for triggering an expandable apparatus for use in a subterranean borehole, comprising:

supplying drilling fluid through a fluid flow path extending through a sleeve member at least partially disposed in a tubular body of an expandable apparatus and through a constriction in the fluid flow path at a selected flow rate;

increasing a pressure of fluid within the sleeve member responsive to a restriction of the fluid flow path through the sleeve member by the constriction;

moving the sleeve member in a downhole direction from a first position to a second position responsive to the increase of the pressure of the fluid within the sleeve member;

guiding the sleeve member in the downhole direction with a guide portion of the sleeve member that travels along a shoulder formed within the tubular body as the sleeve member is moved between the first portion and the second portion;

disengaging a locking member retaining at least one member of the expandable apparatus in the retracted position;

moving the at least one member of the expandable apparatus from a retracted position to an extended position responsive to the movement of the sleeve member from the first position to the second position; and flowing drilling fluid through the constriction in the sleeve member and out a distal end of the expandable apparatus after expanding the at least one member;

retracting the at least one member of the expandable apparatus from the expanded position to the retracted position responsive to the fluid flow through the expandable apparatus;

guiding the sleeve member in an uphole direction with the guide portion of the sleeve member from the second position to the first position;

after expanding and retracting the at least one member, engaging the locking member in order to retain the at least one member in the initial position.

18. The method of claim 17, wherein moving the sleeve member in a downhole direction from a first position to a second position further comprises disengaging a locking member retaining the at least one member of the expandable apparatus in the retracted position.

19. The method of claim 17, further comprising shearing shear screws of a shear assembly retaining the sleeve member in the tubular body in the first position responsive to the restriction of the fluid flow path through the sleeve member by the constriction.

20. The method of claim 17, further comprising biasing the sleeve member to return to the first position responsive to a decrease in the pressure of the fluid in the sleeve member.

21. The method of claim 17, further comprising reaming the borehole with at least one cutting element on the at least one member while the at least one member is in the extended position after moving the at least one member from the retracted position to the extended position.

22. The method of claim 21, further comprising:

decreasing the pressure of the fluid within the sleeve member to enable the at least one member to return to the retracted position from the extended position;

further drilling the borehole with a pilot bit while the at least one member is in the retracted position after reaming the borehole.

* * * * *